US008123092B2

(12) United States Patent
Krulik et al.

(10) Patent No.: US 8,123,092 B2
(45) Date of Patent: Feb. 28, 2012

(54) RETRACTABLE SHOULDER STRAP FOR CARRYING CASE

(75) Inventors: Richard J. Krulik, Dix Hills, NY (US); Richard J. Rekuc, Pattenburg, NJ (US); Karl Konrad, Jr., Allentown, PA (US); Steven J. Rekuc, Atlanta, GA (US)

(73) Assignee: United States Luggage, L.P., Hauppauge, NY (US)

( * ) Notice: Subject to any disclaimer, the term of this patent is extended or adjusted under 35 U.S.C. 154(b) by 1689 days.

(21) Appl. No.: 10/506,912

(22) PCT Filed: Mar. 6, 2003

(86) PCT No.: PCT/US03/07362

§ 371 (c)(1),
(2), (4) Date: May 18, 2005

(87) PCT Pub. No.: WO03/075705

PCT Pub. Date: Sep. 18, 2003

(65) Prior Publication Data

US 2005/0224547 A1 Oct. 13, 2005

(51) Int. Cl.

| | |
|---|---|
| ***B65H 75/40*** | (2006.01) |
| ***B65H 75/48*** | (2006.01) |
| ***A45C 13/26*** | (2006.01) |
| ***A45C 13/30*** | (2006.01) |

(52) U.S. Cl. ..... 224/578; 224/162; 150/108; 242/378.4; 242/384.7; 190/115

(58) Field of Classification Search ..... 224/578, 224/162; 150/108; 242/378.4, 384.7; 190/115
See application file for complete search history.

(56) References Cited

U.S. PATENT DOCUMENTS

| | | | | | |
|---|---|---|---|---|---|
| 1,979,978 | A | * | 11/1934 | Martin | 190/115 |
| 2,009,192 | A | * | 7/1935 | Freysinger | 383/14 |
| 2,769,475 | A | * | 11/1956 | Fisher | 190/115 |
| 3,198,300 | A | * | 8/1965 | Tuttle | 16/405 |
| 4,488,624 | A | * | 12/1984 | Myers | 190/120 |
| 4,508,202 | A | * | 4/1985 | Siegert et al. | 190/115 |
| 4,763,763 | A | | 8/1988 | Sadow | |
| 5,027,874 | A | * | 7/1991 | Gazzola | 150/108 |
| 5,294,029 | A | * | 3/1994 | Shimura et al. | 224/162 |
| 5,555,960 | A | * | 9/1996 | Bartsch | 190/115 |
| 5,722,518 | A | * | 3/1998 | Aumasson | 190/115 |

(Continued)

FOREIGN PATENT DOCUMENTS

| | | |
|---|---|---|
| DE | 40 03 561 C1 | 2/1991 |
| FR | 1 028376 A | 5/1953 |
| WO | WO 03/075705 | 9/2003 |

OTHER PUBLICATIONS

International Search Report mailed Jul. 14, 2003 PCT/US03/07362.

(Continued)

*Primary Examiner* — Justin Larson
*Assistant Examiner* — Lester L Vanterpool
(74) *Attorney, Agent, or Firm* — Abelman, Frayne & Schwab

(57) ABSTRACT

A retractable carry strap (12) for carrying cases (10) such as luggage, suitcases, or briefcases, wherein the retractor device is in the form of compact spring biasing compartments (12) are provided to apply resilient retraction forces (10) to the carry strap to return it to a position in close proximity to the carrying case and to store strap retracting energy when the shoulder strap is extended away from the carrying case.

40 Claims, 23 Drawing Sheets

U.S. PATENT DOCUMENTS

| | | | | |
|---|---|---|---|---|
| 5,762,169 | A * | 6/1998 | Deliman et al. | 190/101 |
| 5,881,932 | A | 3/1999 | Wadden | |
| 5,897,039 | A * | 4/1999 | Swenke | 224/162 |
| 5,950,893 | A | 9/1999 | Heggeland | |
| 6,053,381 | A * | 4/2000 | Fahl et al. | 224/153 |
| 6,536,078 | B2 * | 3/2003 | Tsai | 16/114.1 |

OTHER PUBLICATIONS

International Preliminary Examination Report completed May 14, 2004 PCT US03/07362.

WO 03/075705—WIPO publication for PCT/US03/07362 which corresponds to the present application, International Publication Date Sep. 18, 2003.

International Search Report mailed Jul. 14, 2003 in corresponding PCT application No. PCT/US03/07362.

International Preliminary Examination Reported completed May 14, 2004 in corresponding PCT application No. PCT/US03/07362.

1) Supplementary European Search Report mailed on Sep. 9, 2008 by the European Patent Office in counterpart foreign application No. EP03723709.

* cited by examiner

RETRACTABLE SHOULDER STRAP FOR CARRYING CASE

BACKGROUND OF THE INVENTION

1. Field of the Invention

The present invention relates to a retractable strap device for carry cases such as suitcases, briefcases, computer cases and the like.

2. Description of the Related Art

Carrying cases such as suitcases, briefcases and luggage in general often include a shoulder strap which is fixed to the case (or bag) at opposed locations to facilitate carrying the case over the shoulder. The straps are generally attached at opposed ends of the bag and are loosely configured such that when the case is placed on the floor the strap falls loosely and generally provides an unsightly appearance. In addition, the strap presents a potential danger to the user or passersby by the fact that it can become entangled in an individual's foot and cause the person to trip and fall over the strap. In addition, the use of such luggage on common carriers such as airlines, railroads or the like not only provides a potential hazard where the user or the passersby can become entangled in the shoulder strap but also provides substantial inconvenience in storing the luggage in a storage compartment. For example, when numerous pieces of luggage are stacked in a storage compartment and a corresponding number of shoulder straps are loosely positioned and over adjacent pieces of luggage, personnel responsible for storing and retrieving the luggage are often confused when attempting to identify a specific strap with a particular piece of luggage, often retrieving the wrong piece.

The present invention relates to a retractable shoulder strap device for carry cases such as luggage, suitcases, briefcases, computer cases and the like, wherein the shoulder strap is made to retract neatly into a compact close relation with the carry case by means of relatively compact retractor devices having resilient devices in the form of one or more springs arranged to retract the shoulder strap while permitting the shoulder strap to extend to a user position as may be required by the user during the lifting movement of the carrying case.

SUMMARY OF THE INVENTION

A retractable strap device for a carry case is disclosed, which comprises a flexible strap having at least first and second end portions, and at least one first strap retractor device mounted to at least a first part of the carry case, the strap retractor device including resilient means respectively attached to a first portion of the strap to bias the strap toward a retracted position with respect to the carry case, and a second portion of the strap opposed to the first portion being attached to a correspondingly opposed second part of the carry case. The retractable strap device further comprises means associated with the retractor device for take-up and storage of at least a portion of the strap. Preferably a second strap retractor device is mounted to a second part of the carry case, the second end portion of the strap being attached to the second strap retractor device. The second strap retractor device includes resilient means attached to the second portion of the strap, and means is provided therein for take-up and storage of at least a portion of the strap.

The resilient means in each retractor device may comprise at least one coil-type extension spring. Alternatively at least two coil-type extension springs are provided in each retractor device. Still alternatively, at least three coil-type extension springs may be provided in each retractor device.

Each retractor device preferably comprises a housing and each resilient spring is retained within the housing. Each spring has a first end fixed to the housing and a second end fixed to a slider device, the slider device being adapted to selectively take-up and extend the strap in response to forces applied to the strap. Each end of the strap is attached to a respective slider device, and each slider device is attached to the resilient springs. Each slider device defines an aperture for passage therethrough of the strap, such that when the strap is extended in a direction away from the carry case, the resilient means is extended, and when the strap is relaxed, the resilient means retracts and causes the strap to retract and be stored within the housing. Each retractor housing preferably includes a fixed elongated member oriented transversely to the strap, and each of the first and second end portions of the strap is respectively attached to a respective elongated member attached to a respective housing. Preferably each end portion of the strap is respectively wrapped around the associated fixed elongated member within the associated housing and looped through the aperture in the respective slider device for storage of at least a portion of the strap within each respective housing. Each slider device associated with each housing may define two apertures for reception of each respective end portion of the strap in a double looped manner to thereby increase the amount of strap storage capacity within the housing.

Each housing includes resilient means positioned to be engaged by the slider device to absorb and store energy when the strap is extended to a position which causes the slider device to reach a predetermined location. Each housing preferably forms at least a part of a frame structure for the carry case and is concealed within a part of the carry case. A locking device adapted to prevent the carry strap from sliding movement relative to the retractor device may be provided. The locking device preferably comprises a first slotted block and a second slotted block, the carry strap passing through both the slotted blocks, at least one of the blocks being movable laterally with respect to the other to lock the position of the carry strap at a selected location on the strap to prevent further movement of said strap into the respective retractor device.

A retractor strap device for a carry case such as a business case, luggage or the like is also disclosed, which comprises a housing mounted on at least one side of the carry case and forming part of the framework structure of the carry case, the housing being subdivided into at least two sections, a first section associated with one end portion of a carry strap, and a second section associated with a second end portion of the carry strap. A resilient device is positioned in each of the sections of the housing and having one end fixedly attached to the housing and a second end attached to a slider device, each slider device being attached to respective opposed portions of the carry strap, each slider device defining an opening for reception of a portion of the carry strap. An elongated member is fixedly attached to each section of the housing and oriented transverse to the carry strap, the elongated member being spaced from the respective slider device, the elongated member being positioned to wrap a portion of the strap therearound such that applying opposed forces to the respective end portions of the carry strap causes the carry strap to extend its exposed length as the resilient devices become extended, and releasing the opposed forces on the carry strap permits the resilient device to apply inward and opposed resilient forces to the end portions of the carry strap to cause the opposed portions of the carry strap to return to their stored positions within the housing. The resilient device preferably comprises coil-type extension springs, preferably at least two coil-type extension springs, or at least three coil-type extension springs.

A retractable strap device for a carry case is also disclosed, which comprises a housing mounted on each side of the carry case and forming part of the frame structure of the carry case, and at least one coil-type torsion spring mounted within each housing and adapted to cause two opposed end portions of a carry strap to be retracted within the housing when the spring retracts, and to permit the end portions of the carry strap to be extended in directions opposed to the spring when extension forces are applied to each end of the carry strap.

A retractable strap device for an article carrying case such as an article of luggage or the like is also disclosed, which comprises a flexible strap having a central portion and at least first and second end portions, at least one first strap retractor device mounted on at least one first side of the carry case, the strap retractor device having a housing and at least two resilient coil-type extension springs attached at one end thereof to the housing, and at another end thereof to one end portion of the flexible strap. At least one second strap retractor device is mounted to at least one second side of the carry case, the second side being opposed to the first side, the second strap retractor device having a housing and at least two resilient coil-type extension springs attached at one end thereof to the housing, and at another end thereof to the second end portion of the flexible strap. The first and second end portions of the flexible strap are retracted into each respective housing by inward forces provided by the resilient springs, and when outward forces are applied to the flexible strap to cause the first and second end portions to move away from the retractable devices, the springs become extended so as to permit outward movement of the strap away from the carrying case, while providing resilient return force to the strap, such that when the outward forces are removed, each end portion of the flexible strap returns to a stored position within each respective housing and the central portion of the strap between the opposed end portions assumes a position closer the carrying case.

Preferably each housing is an elongated member having at least three sides, a first side having devices to attach one end of each spring thereto. The first side is shorter than the second and third sides, and the strap retractor devices each include a slider device attached to the opposite ends of the springs, and one end of the flexible strap is attached to the slider device.

An elongated pin is attached to each housing and oriented in a direction transverse to the direction of movement of the flexible strap, the strap being looped around the pin and through an aperture in the slider device, and thereafter exiting the housing such that outward forces applied to the strap cause the strap to exit the housing against the forces provided by the springs, and relaxation of the outward forces causes the springs to return to their unloaded condition, and the end portions of the strap to return to a stored and wrapped position within each respective housing.

Each slider device may define two apertures to receive the flexible strap in a double-wrapped arrangement. Preferably the housing is made of a plastic material, such as polypropylene or acrylonitrile-butadiene styrene (ABS).

Each slider device may comprise a pair of engagement pads at each end thereof, and the housing may include a pair of impact springs positioned and adapted to be engaged by the pads when the slider device is moved to a predetermined position, whereby the impact springs absorb and store energy from each slider device when the flexible strap is extended away from the carrying case to a predetermined position. The flexible strap may extend through a strap locking device, the locking device comprising a first fixed block and a second slider block movable between a first position which permits passage of the strap through respective apertures in the blocks, and a second position of misalignment of the apertures which prevents passage of the strap through the block. The slider block may be manually actuable by a manually operable pin attached thereto.

A carry case having a retractable strap device is also disclosed, which comprises an article carrying case, a flexible strap having at least first and second end portions, at least one first strap retractor device mounted to at least a first part of the carry case, the strap retractor device including resilient device respectively attached to a first portion of the strap to bias the strap toward a retracted position with respect to the carry case, and a second portion of the strap opposed to the first portion being attached to a correspondingly opposed second part of the carry case. A second strap retractor device may be attached to the second end portion of the carry strap, the second retractor device being attached to a second part of the carry case opposed to the first part. The first and second retractor devices are preferably mounted to a frame structure of the carry case and concealed within respective parts of the carry case.

A method of providing a retractable carry strap for a carry case such as a business case, an article of luggage or the like is disclosed, which comprises providing a flexible strap having first and second end portions, attaching one first end of the flexible strap to a first retractor device, the first retractor device including resilient device to bias the first end of the strap toward the first retractor device, mounting the first retractor device on a first part of the carry case, attaching the second end portion of the strap to a second retractor device, the second retractor device including resilient device to bias the second end portion of the carry strap toward the second retractor device, and mounting the second retractor device on a second part of the carry case. The carry case preferably has a wrap around frame structure and the first and second retractor devices are mounted to the frame structure. The method further comprises concealing the first and second retractor devices within the respective first and second parts of the carry case.

BRIEF DESCRIPTION OF THE DRAWINGS

Preferred embodiments of the invention are described hereinbelow with reference to the drawings, wherein:

FIG. 10 is a right side and front perspective view from above of an alternative embodiment of the spring compartment of the present invention wherein individual and distinct sets of coil extension springs are arranged to provide a retraction force on each end of the shoulder strap, each set of springs being comprised of three coil-type extension springs attached to an individual slider which is in turn attached to one end portion of the shoulder strap, such arrangement being particularly adapted for extending along an upper or lower end of a carrying case such as a piece of luggage, suitcase or the like;

FIG. 11 is a right side and front perspective view from above of an alternative embodiment of the spring compartment of FIG. 10, incorporating continuous coil-type extension springs, each of which extends from one slider to the other, with each slider being attached to a respective end portion of a shoulder strap, the arrangement being particularly adapted for positioning along either the upper or the lower end of a carrying case such as a piece of luggage, suitcase or the like;

DETAILED DESCRIPTION OF THE INVENTION

Figure 1:
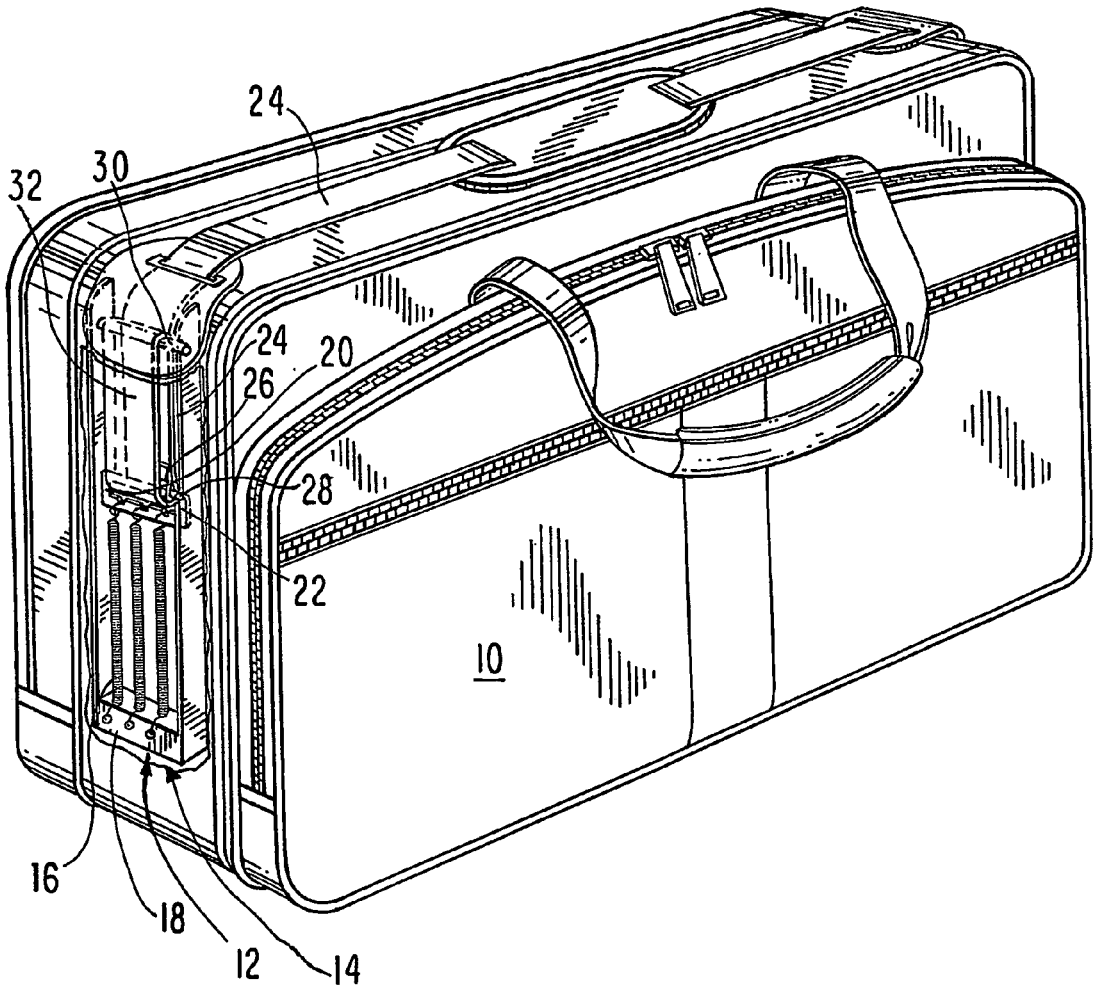
FIG. 1 is a left side and front perspective partial cut away view from above of a carrying case incorporating a retractable shoulder strap constructed according to the present invention, the retractable shoulder strap being connected to a resilient spring compartment on each side of the case (one side not shown), each compartment comprised of a plurality of elongated coil-type extension springs compactly mounted in a compact housing to provide a retraction force on the shoulder strap to bring the shoulder strap in close proximity with the carrying case.
Figure 2:
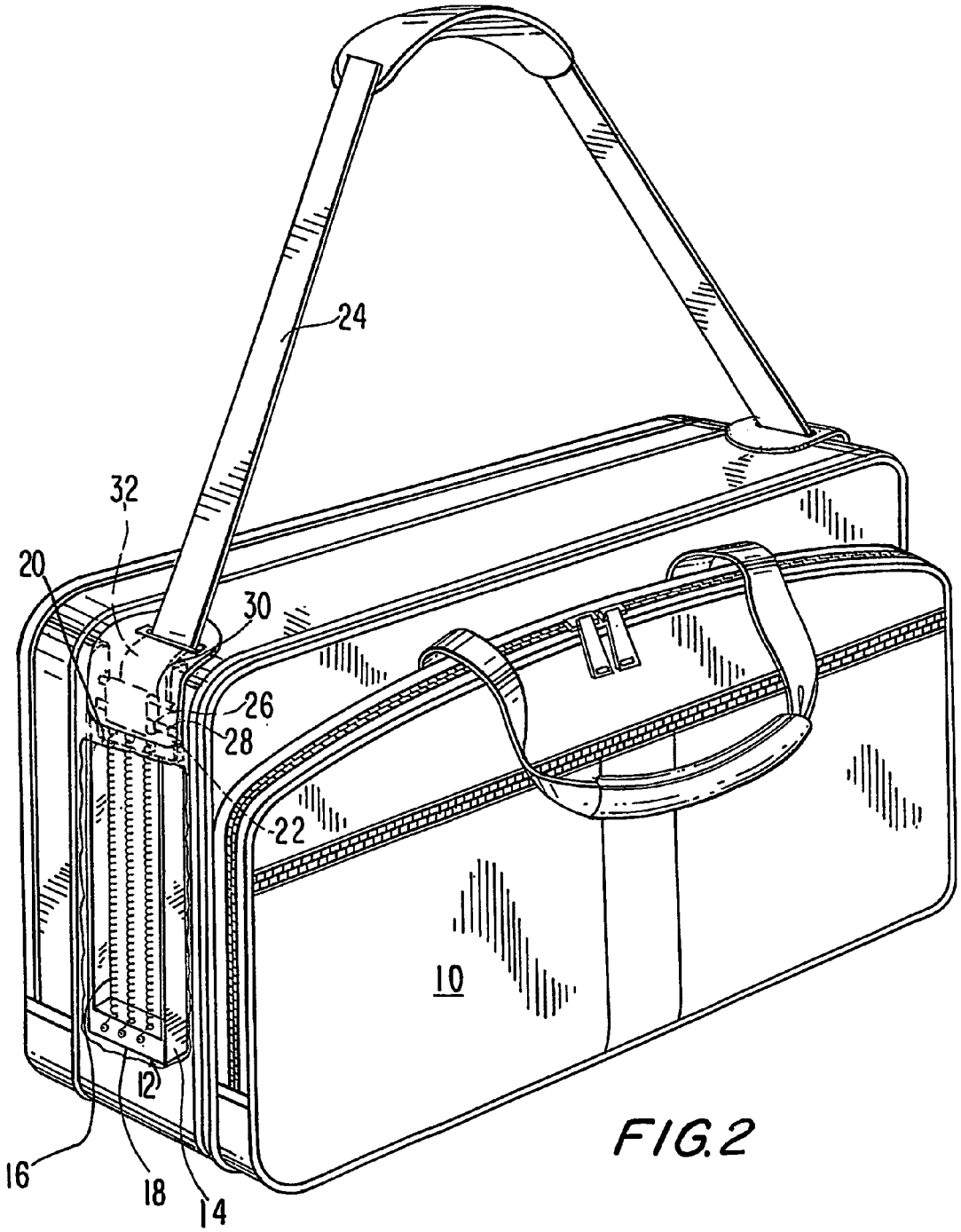
FIG. 2 is a left side and front perspective view from above of the carrying case of FIG. 1 with the shoulder strap and coil extension springs in an extended position when in use.

Referring initially to FIGS. 1 and 2 there is disclosed an article of luggage in the form of a suitcase 10 incorporating the compact retractable shoulder strap system 12 constructed according to the invention. A part of the outer fabric covering of the suitcase 10 is cut away to view the retractable strap system 12. In the embodiment shown in FIG. 1, a spring compartment 12 includes three coil-type extension springs 16 attached at one end to the base wall 18 of spring housing 14 and at the other end to a slider device 20 which resembles a typical pressed metal slotted buckle having a rectangular shape and an oval shaped slot. Housing 14 is preferably made of molded plastic material such as polypropylene or acrylonitrile-butadiene styrene (i.e., ABS). As noted the slider 20, which is preferably stamped from pressed steel, includes a slot 22 through which shoulder strap 24 passes and is looped upon itself as shown. In particular, the end of the shoulder strap is initially looped at 26 about slider end bar 28 and stitched to form a sewn loop. Thereafter the shoulder strap 24 is made to extend upwardly and looped around fixed steel pin 30 so as to extend downwardly at strap portion 32 and thereafter around loop 26 so as to extend upwardly at 24.

It can be seen that when shoulder strap 24 is pulled upwardly the looped portions of the shoulder strap are taken up as shown and the slider moves upwardly against the downward spring force provided by springs 10 as shown clearly in FIG. 2. When the shoulder strap is released by the user it returns to the position shown in FIG. 1. A suitable strap lock similar to those provided in automobile seat belt mechanisms may be provided to lock and fix the position of the shoulder strap when in the extended position. Such locks are well known and include mechanical locks and inertia locks and may be used in conjunction with the present invention. A suitable and appropriate mechanical slider lock will be disclosed hereinbelow. The slider may be arranged to travel in grooves (not shown) in the side walls of housing 14.

As can be seen in the drawings, housing 14 actually forms part of the frame structure of the article of luggage by attachment to a wrap-around frame sheet, preferably a plastic sheet material.

Figure 3:
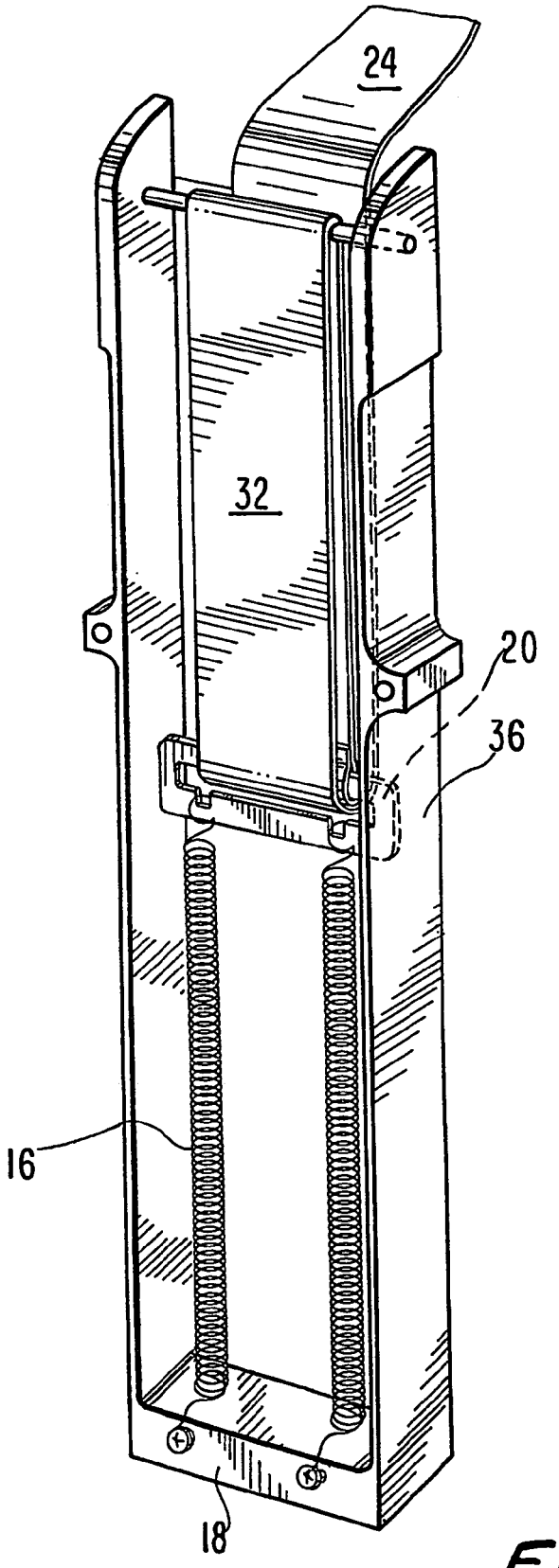
FIG. 3 is a right side and front perspective view from above of an alternative preferred embodiment of the spring compartment utilized for retracting the shoulder strap according to the present invention wherein two elongated coil springs are incorporated to provide a retracting force to the shoulder strap through an appropriate slider device which resembles a belt buckle of a well-known type, the springs being spaced equally from the center of the slider to provide a uniform balanced retracting force to the shoulder strap.

Referring now to FIG. 3 there is shown an alternative preferred embodiment of a spring compartment which can be utilized in place of the spring compartment 12 shown in FIG. 1. The spring compartment 36 in FIG. 3 is actually preferred for the reason that there are dual coil-type extension springs 16 which are equally distant from the center of slider 20 and provide a balanced force to the slider. The shoulder strap 24 is arranged in the same manner as is the shoulder strap shown in FIGS. 1 and 2. In operation the embodiment of FIG. 3 is the same as the embodiment of FIGS. 1 and 2 in that when the shoulder strap is extended, the shoulder strap moves upwardly with the slider mechanism 20 in the same manner as is shown in FIGS. 1 and 2. As is noted previously, the slider 20 is preferably a pressed steel stamping and the strap is preferably a material which has high strength and low friction characteristics such as nylon. Nylon is preferred in order to facilitate movement of the nylon strap when engaged with itself as in the looped conditions as shown in FIGS. 1-3; however, other suitable strap materials such as cloth, plastic, etc., may be used. The springs 16 are preferably made of a suitable spring steel and the spring rate (or force per unit of compressed distance is particularly determined by the amount of retraction force required. In particular it is preferred that the springs are fully extended when the bag is lifted in an empty condition in order to make certain that the springs become fully extended when the bag is in the fully loaded condition. However, depending upon the individual circumstances and requirements, the spring rate may be varied from bag to bag as needed.

Figure 4:
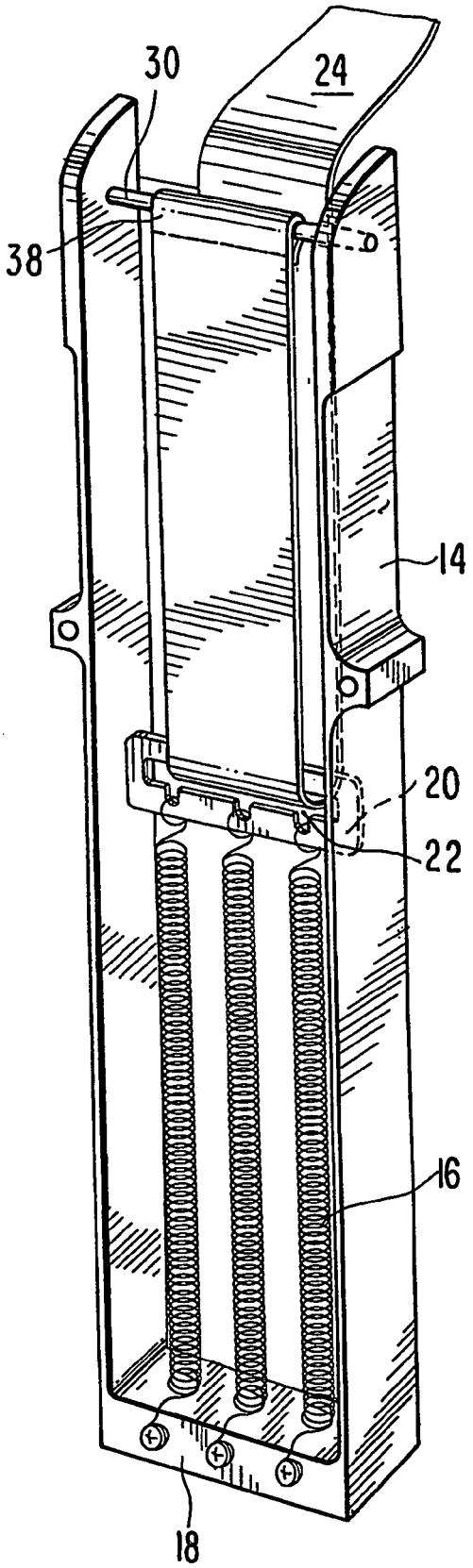
FIG. 4 is a right side and front perspective view from above of an alternative embodiment of the spring compartment of the invention wherein three coil-type extension springs respectively attached between the slider and the housing, one spring being attached to the center of the slider and the remaining two springs being equally spaced from the center spring to provide balanced forces on the slider.

Referring now to FIG. 4, there is shown an alternative embodiment of the spring compartment 12 of FIGS. 1 and 2, which utilizes three springs attached to the lower end wall 18 of frame 14 and at the upper end to a slider 20 identical to the devices previously disclosed. In the embodiment of FIG. 4 however, the shoulder strap is looped and stitched at 38 about fixed steel pin 30 and arranged to extend downwardly and through slot 22 of slider 20 and to extend upwardly toward the shoulder strap portion 24. In operation the mechanism functions the same as the device previously disclosed.

Figure 5:
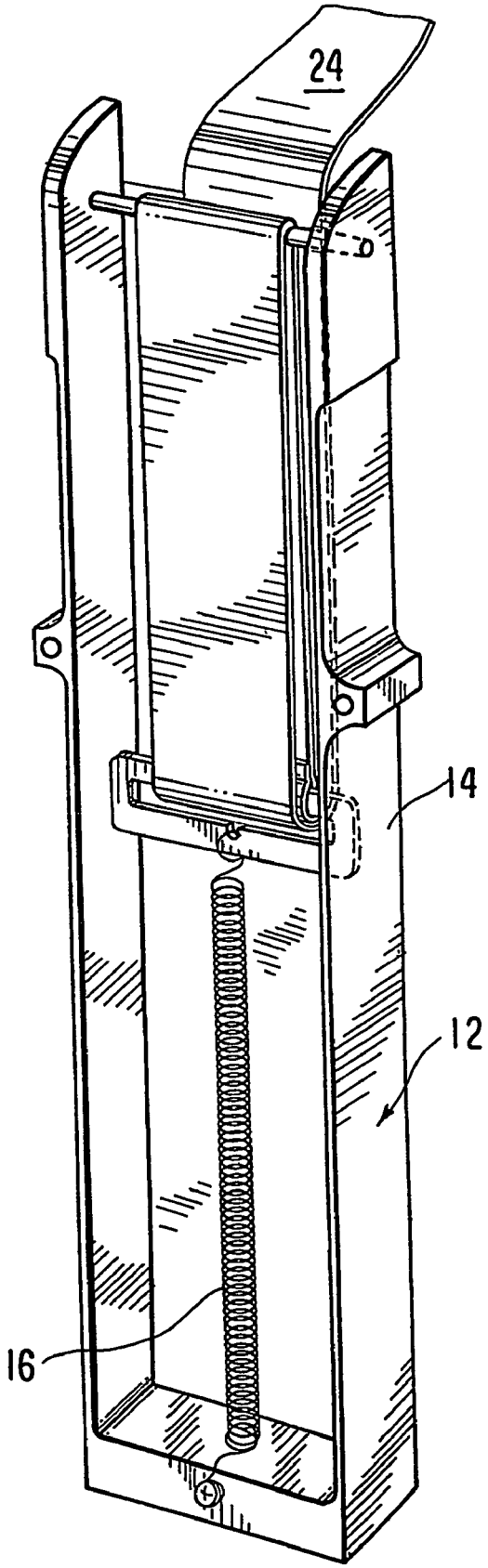
FIG. 5 is a right side and front perspective view from above of an alternative embodiment of the spring compartment shown in FIG. 4, incorporating a single coil-type extension spring to provide a retracting force on the shoulder strap, the shoulder strap being attached to the slider and looped around a fixed pin, and then looped upon itself to facilitate a greater range of shoulder strap length within the generally confined space of the spring compartment.

Referring now to FIG. 5, there is shown an alternative embodiment of the spring compartment 12 of FIGS. 1 and 2, which includes housing 14 identical to the previous embodiments. In this embodiment, a single spring 16 is used to provide a retraction force on shoulder strap 24 and functions in the same manner as the previous embodiments. However, depending upon design parameters, the spring rate of the spring 16 should be appropriately selected.

Figure 6:
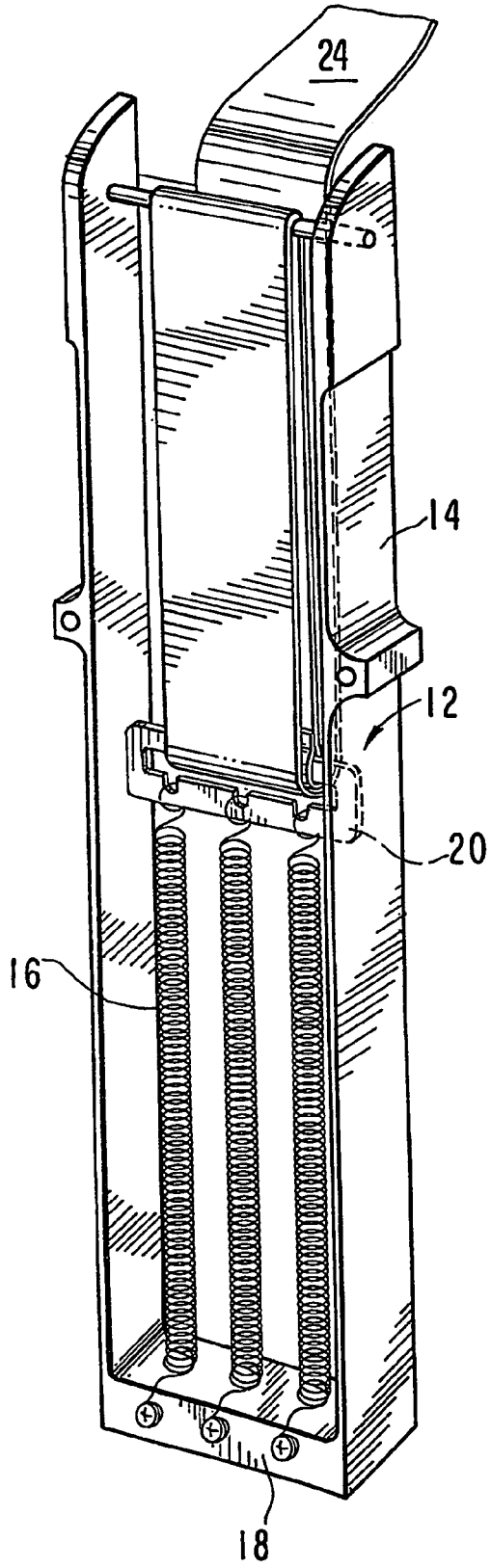
FIG. 6 is a right side and front perspective view from above of an alternative embodiment of the spring compartment of FIG. 5, incorporating three coil-type extension springs in combination with the shoulder strap attachment similar to that of FIG. 5.

Referring now to FIG. 6, there is shown yet another alternative embodiment of spring compartment 12 which includes housing 14 and three springs 16. In this embodiment however, the looping arrangement of shoulder strap 24 with slider 20 is identical to that shown in FIG. 3, the only difference being that in this embodiment, three springs 16 are utilized rather than the two springs shown in FIG. 3.

Figure 7:
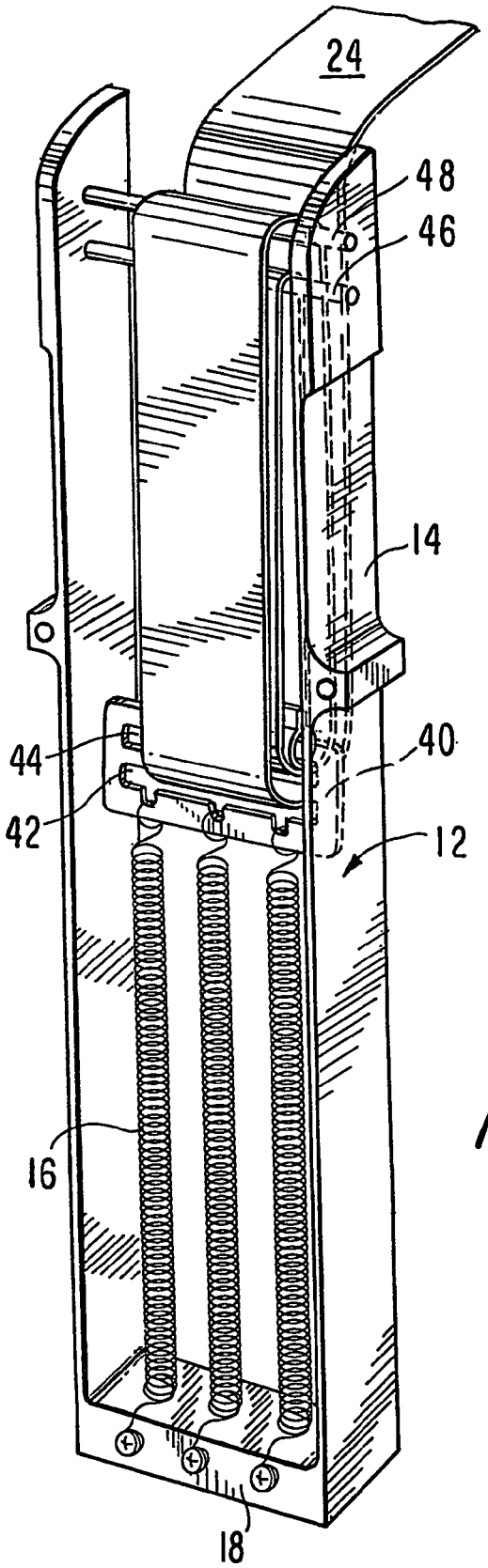
FIG. 7 is a right side and front perspective view from above of a spring compartment incorporating three coil-type extension springs in combination with a slider having dual slots in order to facilitate multiple loops of the shoulder strap and to facilitate compact storage of shoulder strap having capability of extending to a greater length than that of the embodiments shown with the single loop.

Referring now to FIG. 7, there is shown yet another alternative embodiment of spring compartment 12 in which three springs 16 are mounted in housing 14. In this embodiment, however, slider 40 includes dual rectangular slots 42, 44 which facilitates a double loop combination of the nylon webbing of shoulder strap 24 about fixed steel pins 46, 48 as shown. In this embodiment the additional looping of the nylon webbing of shoulder strap 24 facilitates compact storage of additional length of webbing 24 to facilitate the shoulder strap function of the carrying case without need for extension of the length of the spring compartment 12. In particular the need for a relatively low friction webbing material is underscored in the embodiment of FIG. 7 in view of the arrangement whereby the webbing is rubbing and sliding against itself as the shoulder straps move up and down during use.

Figure 8:
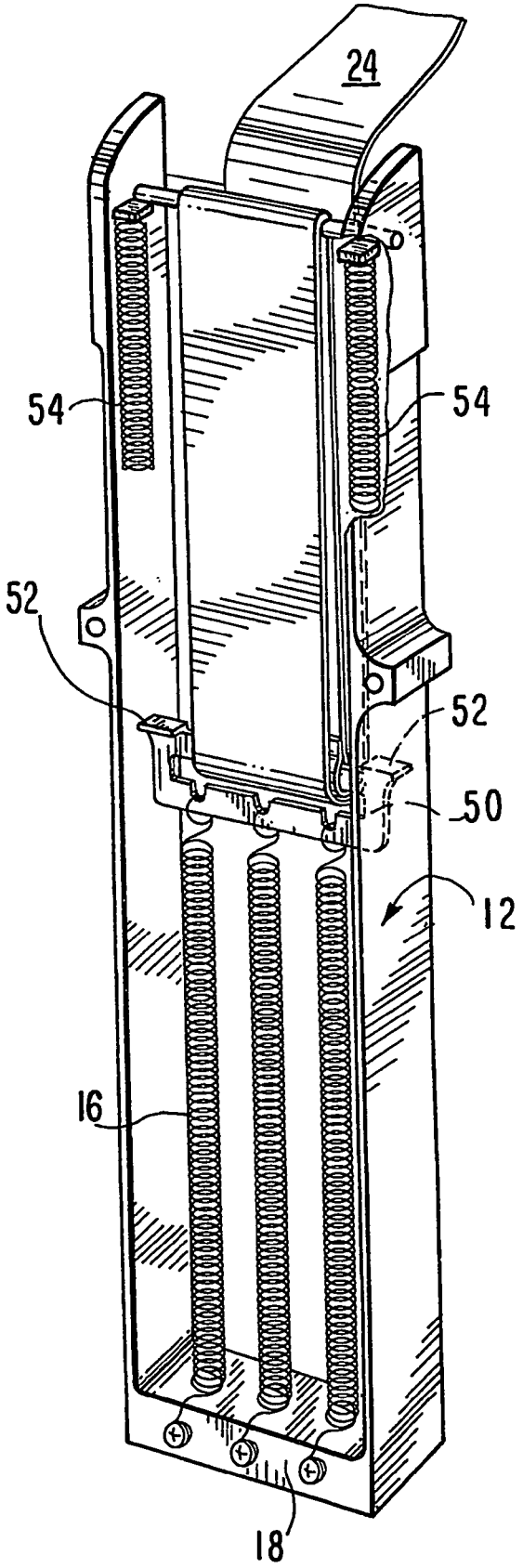
FIG. 8 is a right side and front perspective view from above of a spring compartment similar to FIG. 6, having a pair of impact absorber springs arranged to be engaged by the slider when the shoulder strap is extended beyond a predetermined extent.

Referring now to FIG. 8, there is shown an alternative embodiment of the spring compartment 12 as illustrated and includes a slider 50 which includes pads 52 which are arranged to engage impact springs 54. Thus although the function of the device shown in FIG. 8 is similar to the function of the devices shown in the previous embodiments, in the FIG. 8 embodiment the pads 52 are made to engage impact springs 54 in order to promote smooth and continuous upward operation of the shoulder strap by the fact that the energy imparted to the shoulder strap is absorbed and stored in the impact springs 54. The looping arrangement through and about slider 50 is similar to the arrangement shown in FIGS. 1 and 2.

Figure 9:
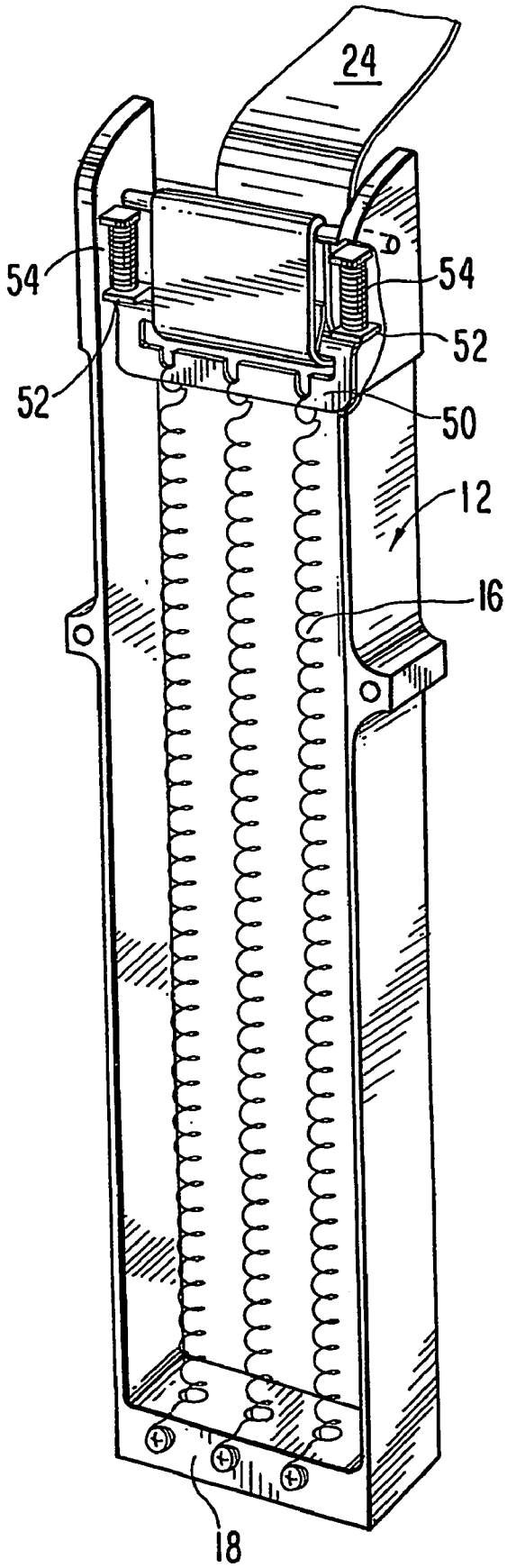
FIG. 9 is a right side and front perspective view from above of the spring compartment of FIG. 8, illustrating the shoulder strap in an extended position and the coil-type extension springs in their extended positions, with the impact absorber springs being in correspondingly compressed conditions.

FIG. 9 illustrates the spring compartment of FIG. 8 when the shoulder strap is in an extended position and the springs 16 are extended. In the condition shown in FIG. 9 the impact springs 54 are compressed by the engagement of pads 52 of slider 50 so as to store energy and to promote smooth and continuous upward movement of the shoulder strap 24.

Figure 10:
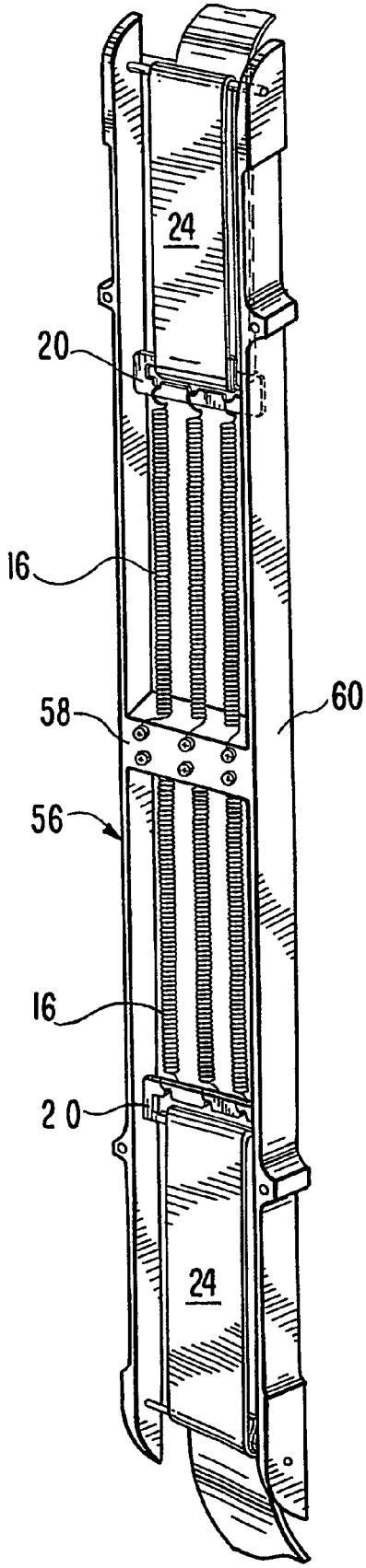

Referring now to FIG. 10, there is illustrated an alternative embodiment 56 of a spring compartment which may extend along the upper end of a carrying case. In this embodiment, there are two separate and individual sets of springs 16 as shown which are individually connected to sliders 20 as shown and fixedly connected to a cross rib 58 of the housing 60. The looping arrangement of the nylon webbing of the shoulder strap 24 is as shown, i.e. a single loop through slider 20 on each side. Accordingly in operation when the shoulder strap 24 is extended, the individual sets of springs 16 are extended in their individual compartments as is shown in connection with the previous embodiments.

Figure 11:
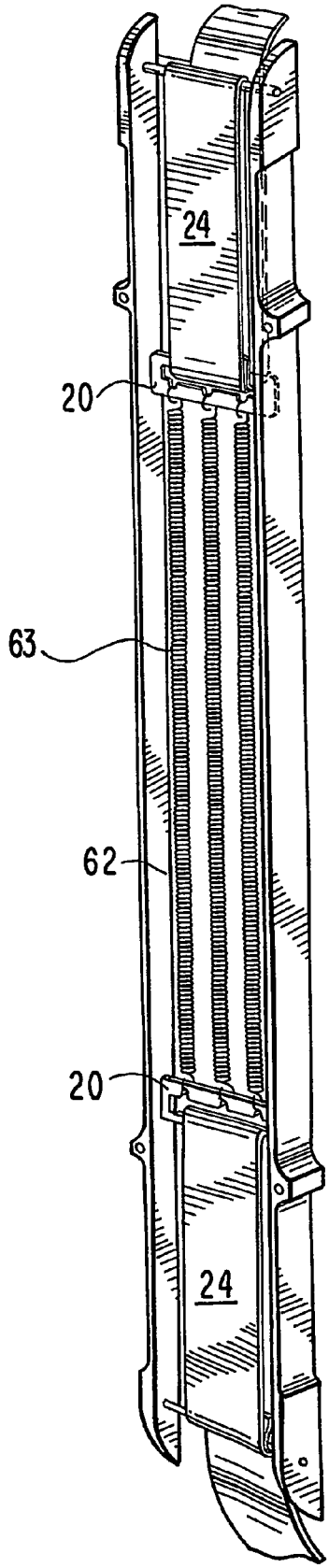

Referring now to FIG. 11 there is illustrated still another alternative embodiment of a spring compartment 62 which utilizes elongated coil-type extension springs 63 which are of greater length than the springs 16 utilized in the previous embodiments. In the embodiment in FIG. 11 there are dual sliders 20 of the type utilized in the previous embodiments. Three springs 62 extend between dual sliders 20 and are made to extend and store energy when nylon shoulder strap 24 is extended to an upward position. Although the embodiment in FIGS. 10 and 11 are illustrated as being adaptable for positioning along the upper end of a carrying case they may very well be positioned along the lower end of a carrying case.

Figure 12:
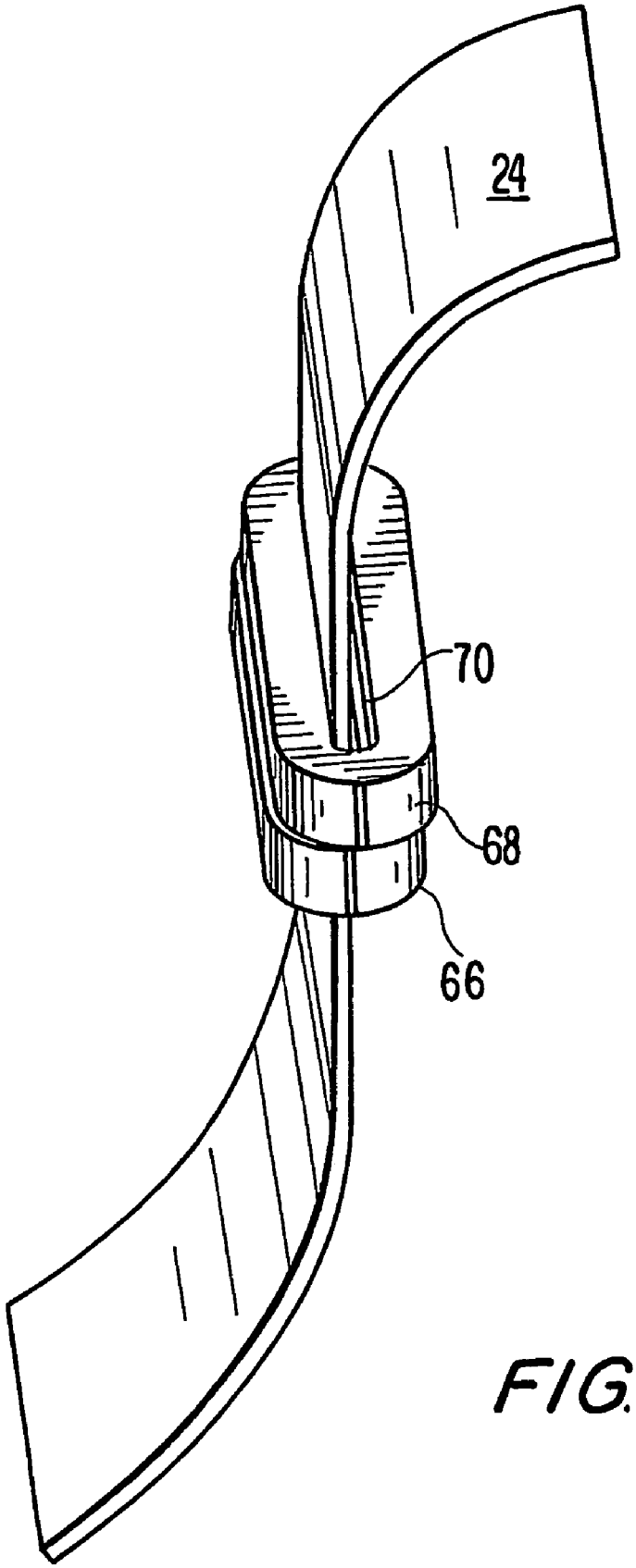
FIG. 12 is a side perspective view from above of a shoulder strap of the present invention incorporating a locking device in the form of a pair of locking blocks which include a first slotted fixed block and a second slotted slider block, the slider block intended to be shifted from a first position in which the shoulder strap is free to slide, to a second position which locks the shoulder strap in position, the slider block being shown in the unlocked position.
Figure 13:
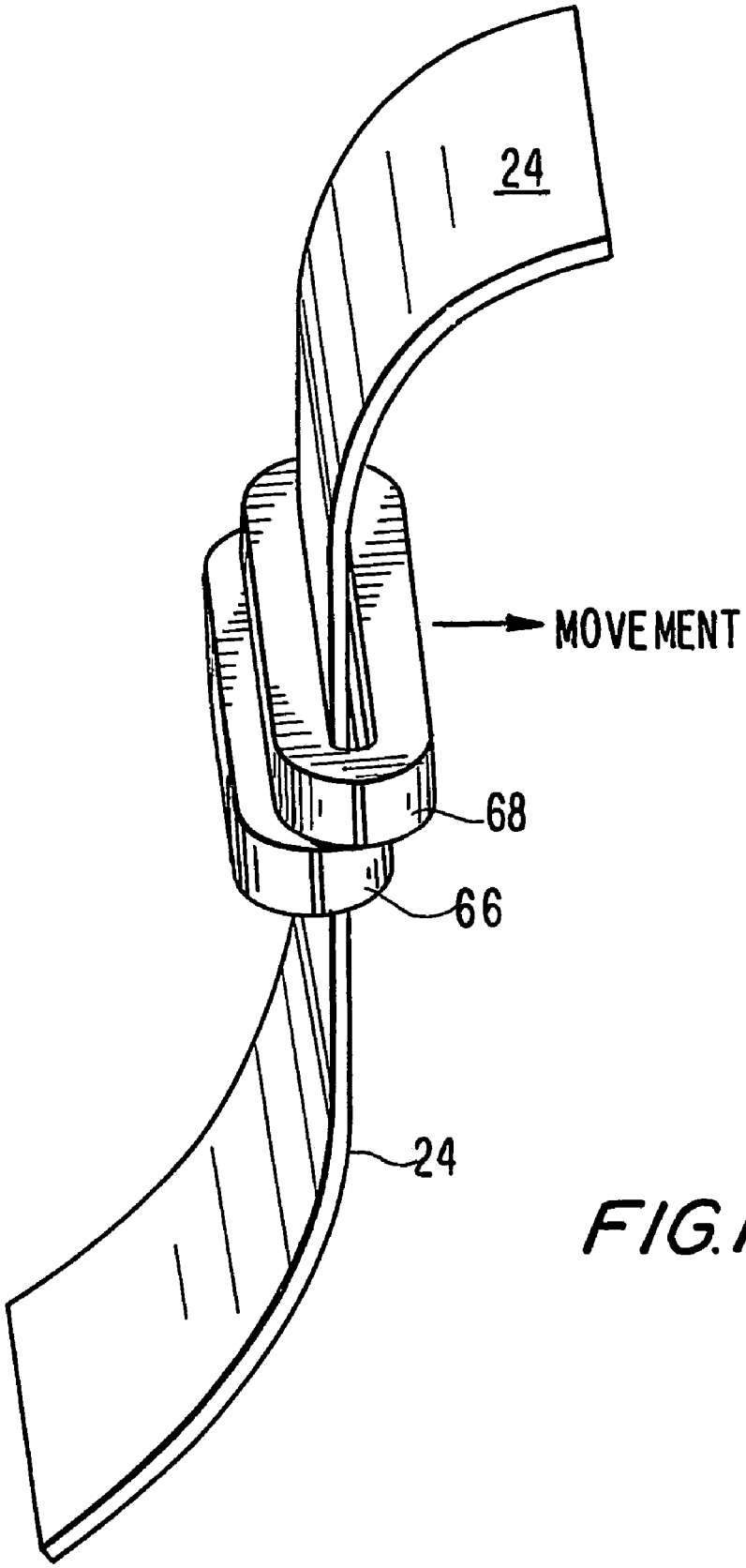
FIG. 13 is a side perspective view from above of the shoulder strap locking device of FIG. 12, illustrating the upper slidable block shifted to a position which locks the strap to fix the position of the strap relative to the fixed slider block.

Referring now to FIG. 12 there is illustrated a suitable locking mechanism which may be utilized to fix the position of the nylon web shoulder strap. In this mechanism a lower block 66 is provided with a central slot 66 (not shown) through which shoulder strap 24 extends. Lower block 66 is preferably made of thermoplastic elastomer (TPE) or thermoplastic rubber (TPR) fixed to a housing member or other fixed device. Upper slider block 68 which is also preferably made of a suitable non-slippery material such as thermoplastic elastomer (TPE) or thermoplastic rubber (TPR) includes a slot 70 through which nylon shoulder strap web extends. The movable block 70 is made to slide in a lateral direction as shown in FIG. 13 to engage and jam the shoulder strap web 24 as shown so as to fix the position of the shoulder strap in a predetermined position. As noted, the lower block 66 may be fixed to any fixed structure of the carrying case and the upper block 68 may be arranged to be slidably moved laterally as shown to fix the position of the nylon webbing by engagement and jamming of the webbing between the slots of the respective blocks 66 and 68. A suitable locking device may be provided which may be manually operated, as will be shown and described in FIG. 18 in conjunction with another embodiment.

Figure 14:
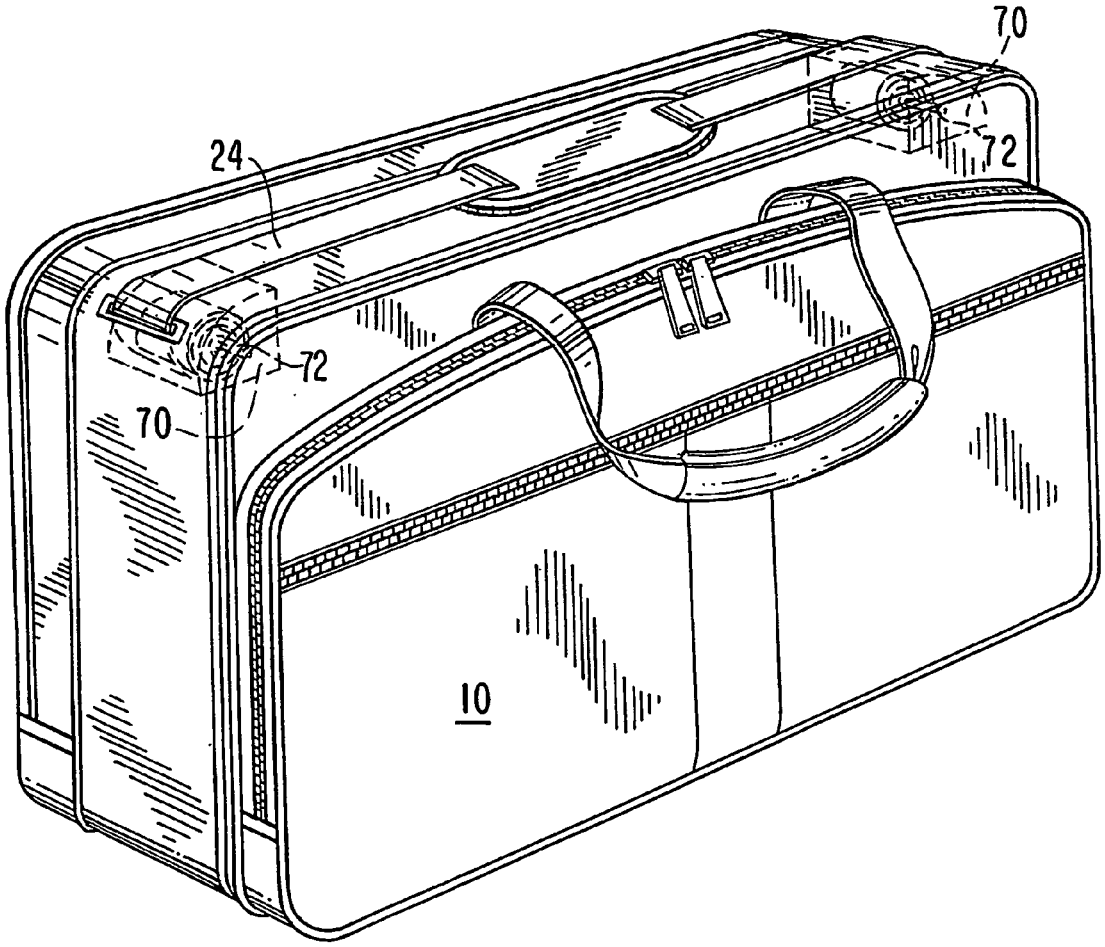
FIG. 14 is a left side and front perspective view from above of a carrying case similar to the carrying case shown in FIG. 1 incorporating a retractable shoulder strap device which utilizes a wire coil-type torsion spring to provide a retracting force to either end of the shoulder strap, the torsion spring being relatively compact and positioned in a spring compartment at either of the upper ends of the carrying case.

Referring now to FIG. 14 there is shown an alternative arrangement of spring devices to provide retraction forces on the shoulder strap 24 of a carrying case or piece of luggage 10. The spring compartments 70 are each positioned at an upper corner of the suitcase and include a spring wire coil-type torsion spring mounted relative to a fixed shaft 72 as shown. The precise structure of the spring wire device coil-type spring will be described in conjunction with FIGS. 20-22.

Figure 15:
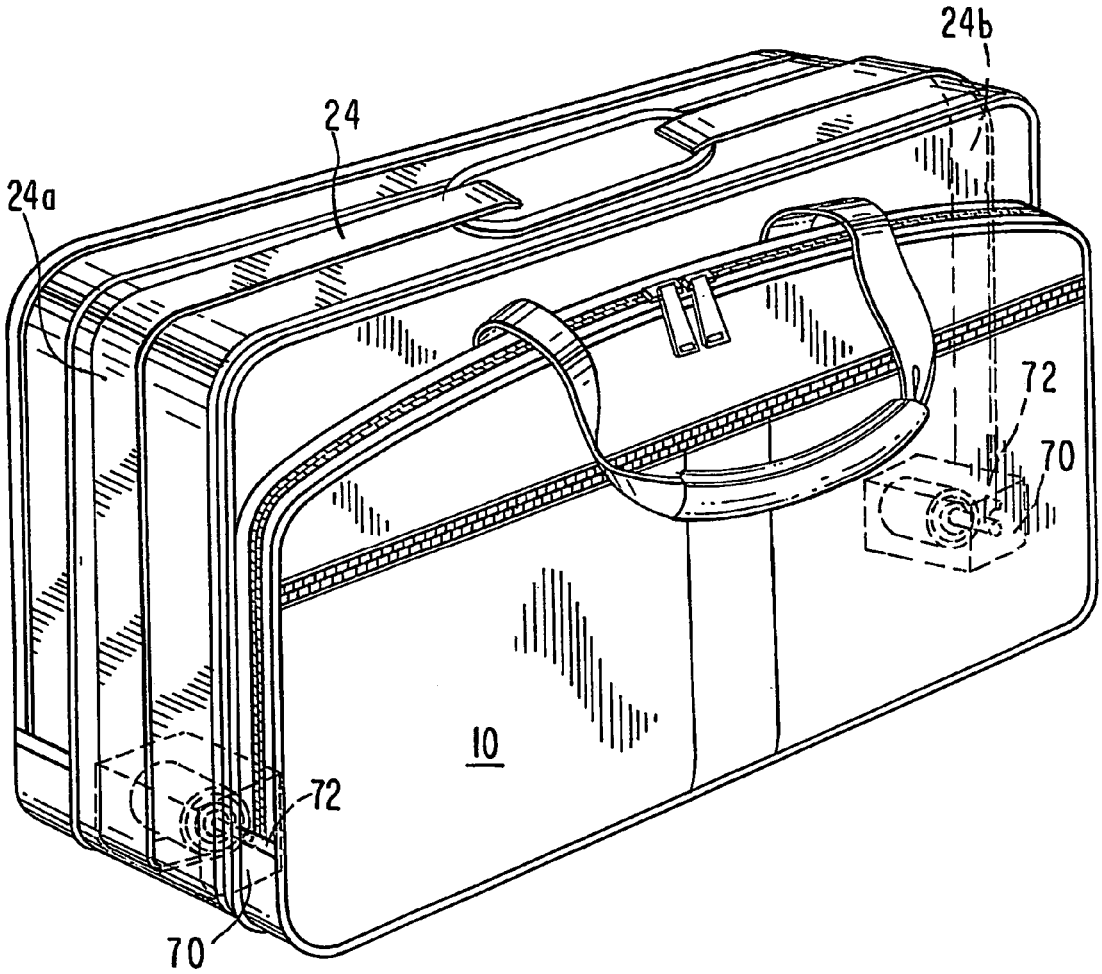
FIG. 15 is a left side and front perspective view from above of a carrying case incorporating a retractable shoulder strap system similar to that of FIG. 14 incorporating coil-type torsion spring retracting units each positioned at the respective lower ends of the carrying case.

FIG. 15 illustrates still another alternative embodiment wherein spring compartments 70 identical to those shown in FIG. 14 are positioned at the lower corners of the carrying case and connected to the shoulder strap 24 via extended portions of the shoulder strap 24 shown at 24*a* and 24*b* which extend along the sides of the carrying case.

Figure 16:
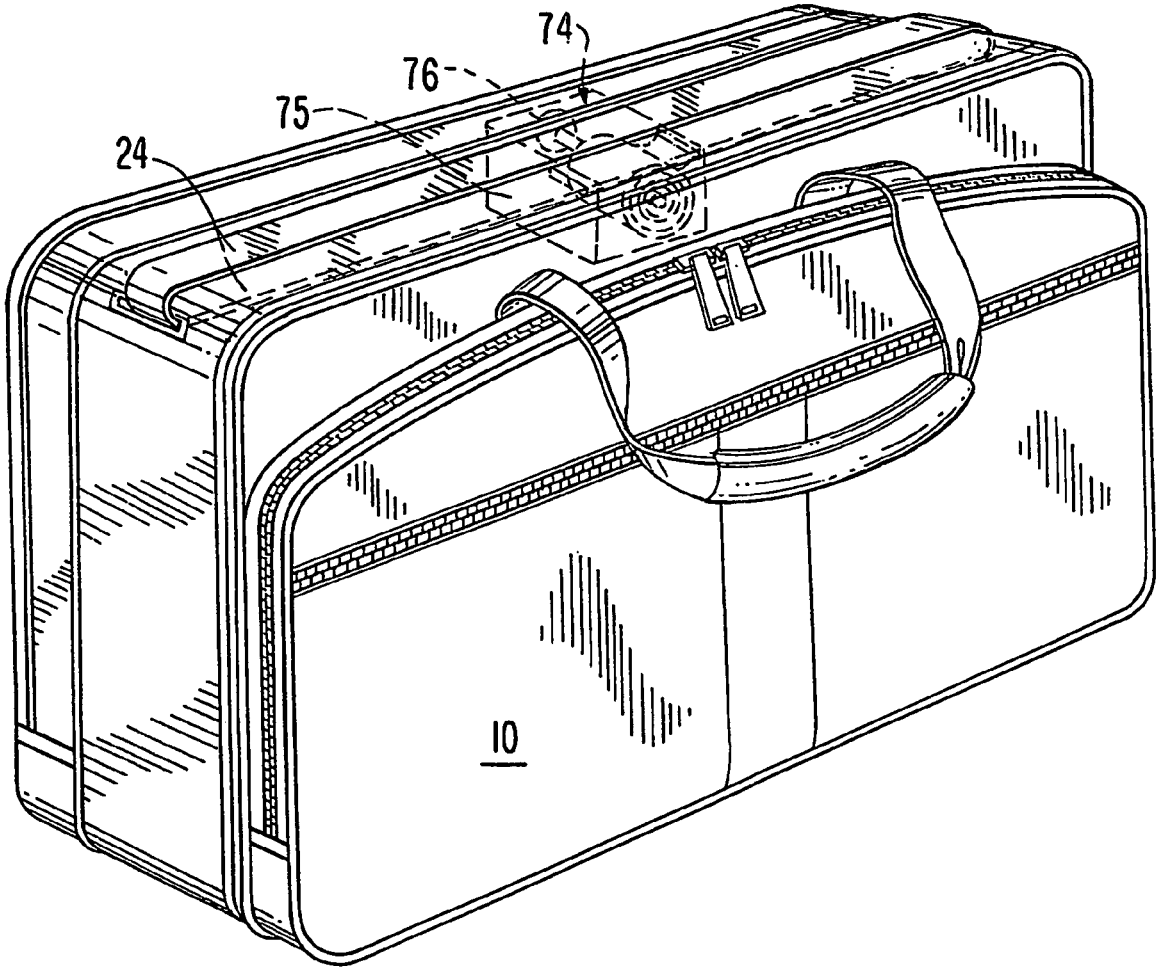
FIG. 16 is a left side and front perspective view from above of an alternative embodiment of the present invention incorporating a single resilient retracting spring unit positioned at the upper end of a carrying case and incorporating a single elongated coil-type torsion spring compartment for retracting both ends of the shoulder strap and permitting extension of the shoulder strap from both ends.

FIG. 16 illustrates still another alternative embodiment of a spring compartment 74 which utilizes a single coil-type torsion spring which is mounted with respect to a fixed pin 76 in the manner shown. In particular opposed portions of the nylon web shoulder strap 24 are wrapped in spiral fashion upon themselves and are made to unravel simultaneously and emerge from the left side and from the right side of the compartment housing 75 as shown, while the individual coil spring mounted about pin 76 unwinds as will be described in conjunction with FIGS. 20-22.

Figure 17:
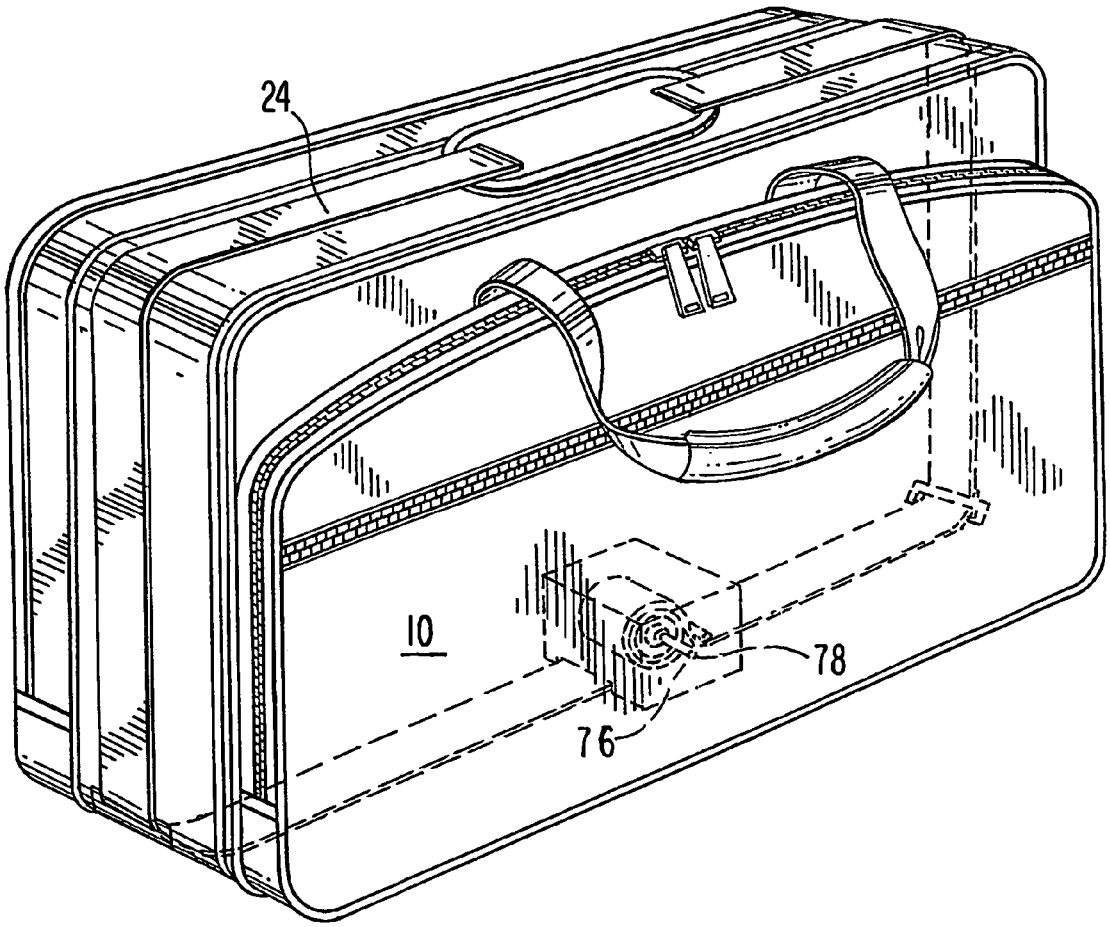
FIG. 17 is a left side and front perspective view from above of an alternative embodiment of the arrangement shown in FIG. 16, with the resilient coil-type torsion spring compartment positioned centrally of the bottom end of the carrying case and arranged to provide a retractable shoulder strap which extends along the bottom end, up the sides and along the top end of the carrying case.

FIG. 17 illustrates another alternative embodiment of the device shown in FIG. 16 of the spring compartment 76 being positioned at the lower end of the carrying case. In the arrangement shown in FIG. 17 the spring compartment 76 includes a fixed pin 78 about which a coil-type torsion spring is mounted in the manner as will be described in conjunction with FIGS. 20-22. Essentially the coil spring is of a thin spring piano wire and has one end fixed to a rotatable axle and the other end fixed to the housing such that when the webbing is unraveled and made to rotate with the axle the axle will cause the coil spring to change its pitch (i.e. the distance between coils) and store energy when then shoulder strap is extended. When the shoulder strap is released the coil spring will provide the retraction force by the energy stored therein.

Figure 18:
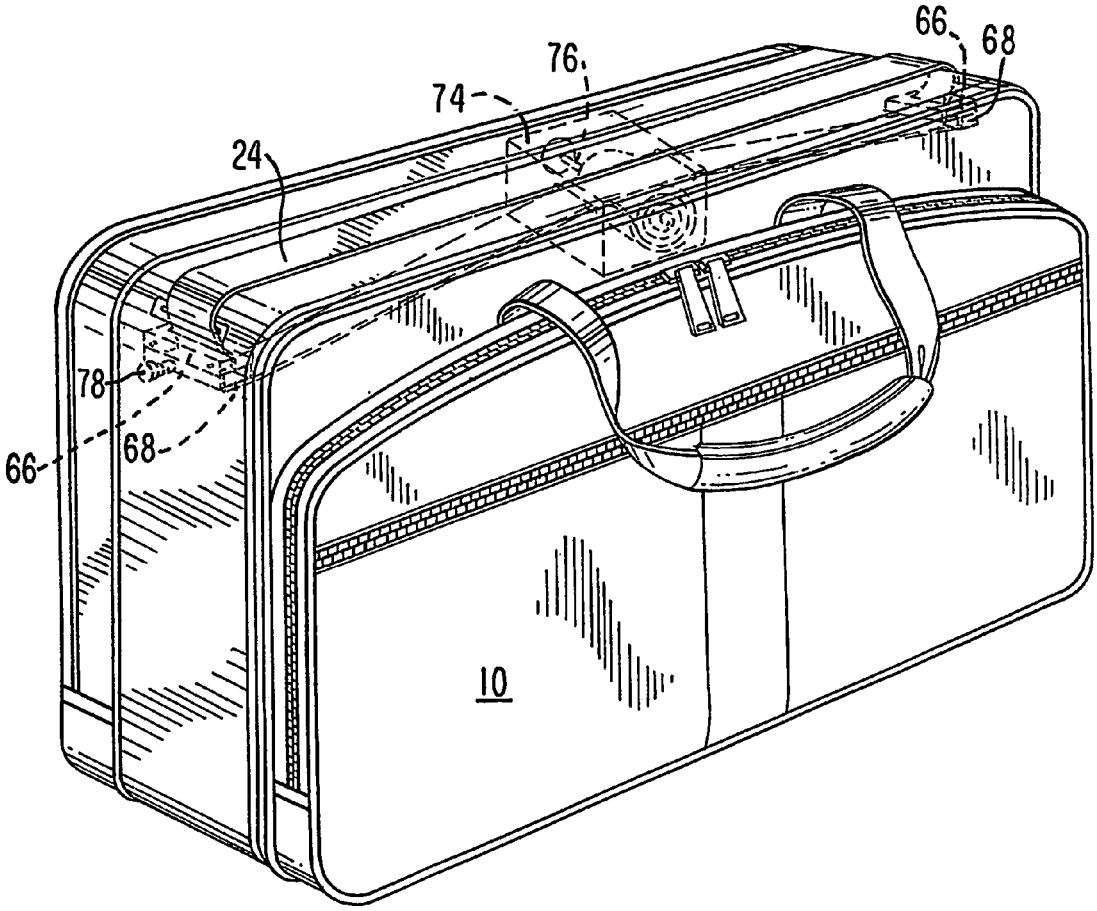
FIG. 18 is a left side and front perspective view from above of a carrying case having a retractable shoulder strap arrangement similar to FIG. 16, but incorporating a pair of locking blocks at either of the upper ends of the carrying case, one locking block of each pair having a slot through which the shoulder strap passes, and the other locking block being movable and having a similar slot through which the shoulder strap passes, the movable block being slidable between a first position whereby the shoulder strap is freely slidable and a second position wherein the shoulder strap is locked.

Referring now to FIG. 18 there is shown still another embodiment of the piano wire coil-type spring compartment 74 similar to that shown in FIG. 16. In this embodiment, however, a manually actuable locking device consisting of a fixed block 66 and a slider block 68 is provided. In this embodiment the slider block 68 arrangement is similar to the lock device shown in FIG. 12, except that the slider block 68 is positioned below the fixed block 66. The slider block 68 is movable by manually actuating pin 78 and thereby causing the shoulder strap 24 to be jammed between the slots of the respect slider blocks as described previously. However, alternative suitable materials such as plastics, metal, or the like, may be used. Slider blocks 66, 68 may be made of a high-friction material such as TPE or TPR as disclosed previously.

Figure 19:
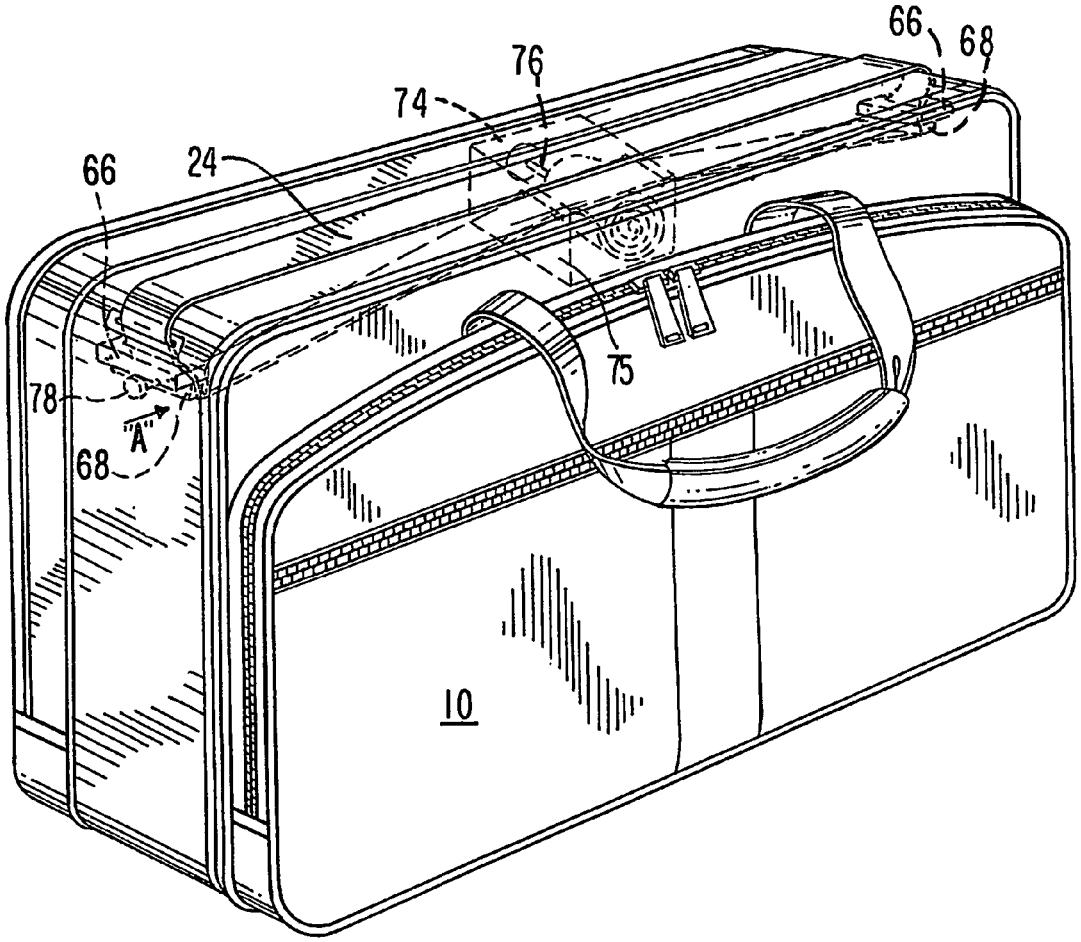
FIG. 19 is a left side and front perspective view from above of a carrying case incorporating a retractable should strap device similar to that of FIG. 18, illustrating the movable lower locking block of each locking device after movement to a shoulder strap locking position.

FIG. 19 illustrates the carrying case of FIG. 18 after the slider block has been moved to a locked position by manually depressing button 78 inwardly as shown by arrow "A". In FIG. 19 slider block 68 has been shifted relative to fixed block 66. As noted previously, the spring compartment 74 is as disclosed in conjunction with the embodiment of FIG. 14 and includes a spring wire coil-type torsion spring attached at one end to a rotating axle and at the other end to the fixed housing 75 so as to respectively store energy when the shoulder strap 24 is extended and to release the energy when the shoulder strap is permitted to retract.

Figure 20:
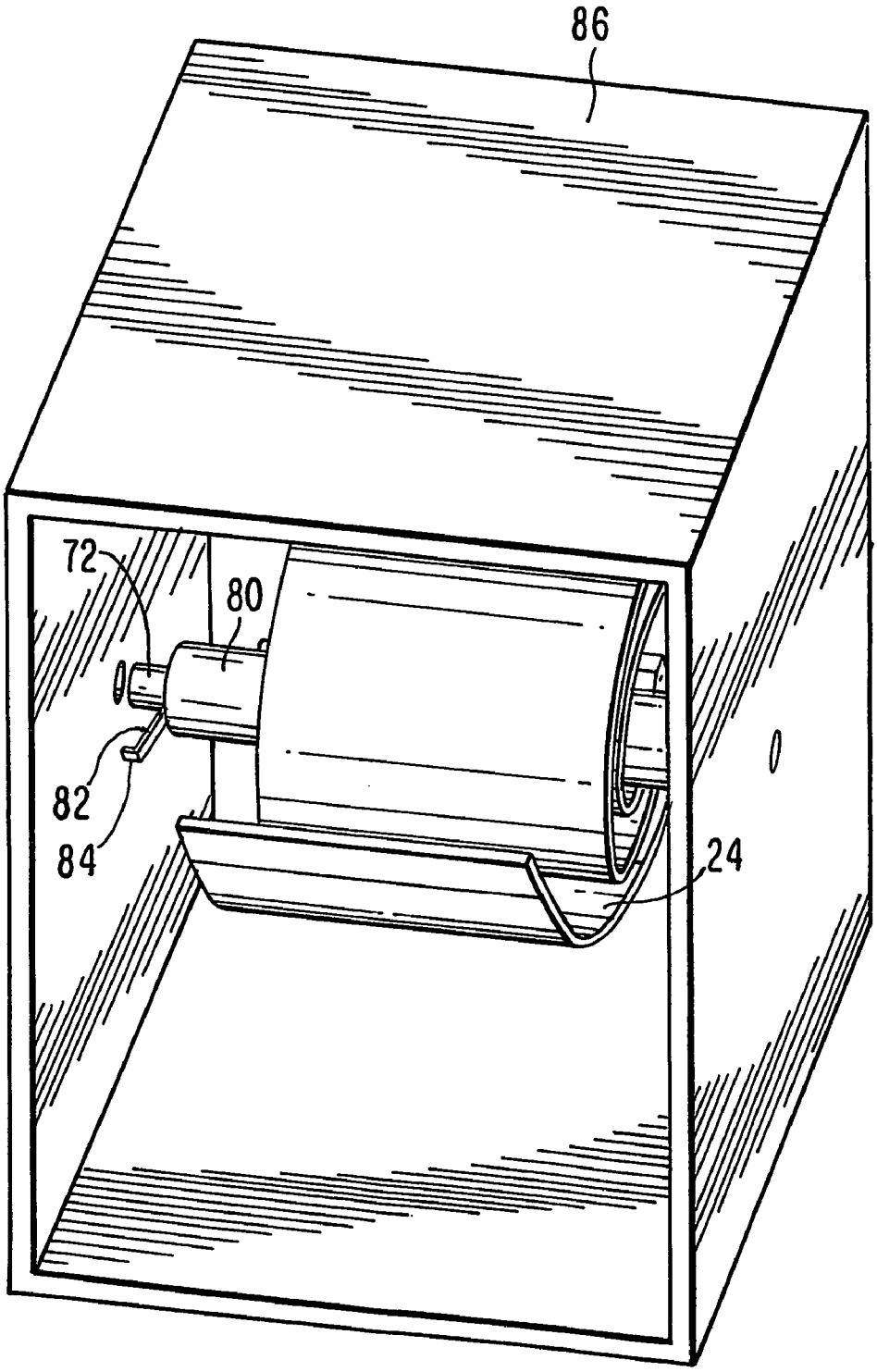
FIG. 20 is a perspective view of the shoulder strap torsion coil-type spring retracting unit shown in FIGS. 14-19, illustrating the use of a spring wire coil-type torsion spring having a long arm fixed to the housing, and a short arm (not shown in FIG. 20) fixed to a rotatable axle.
Figure 21:
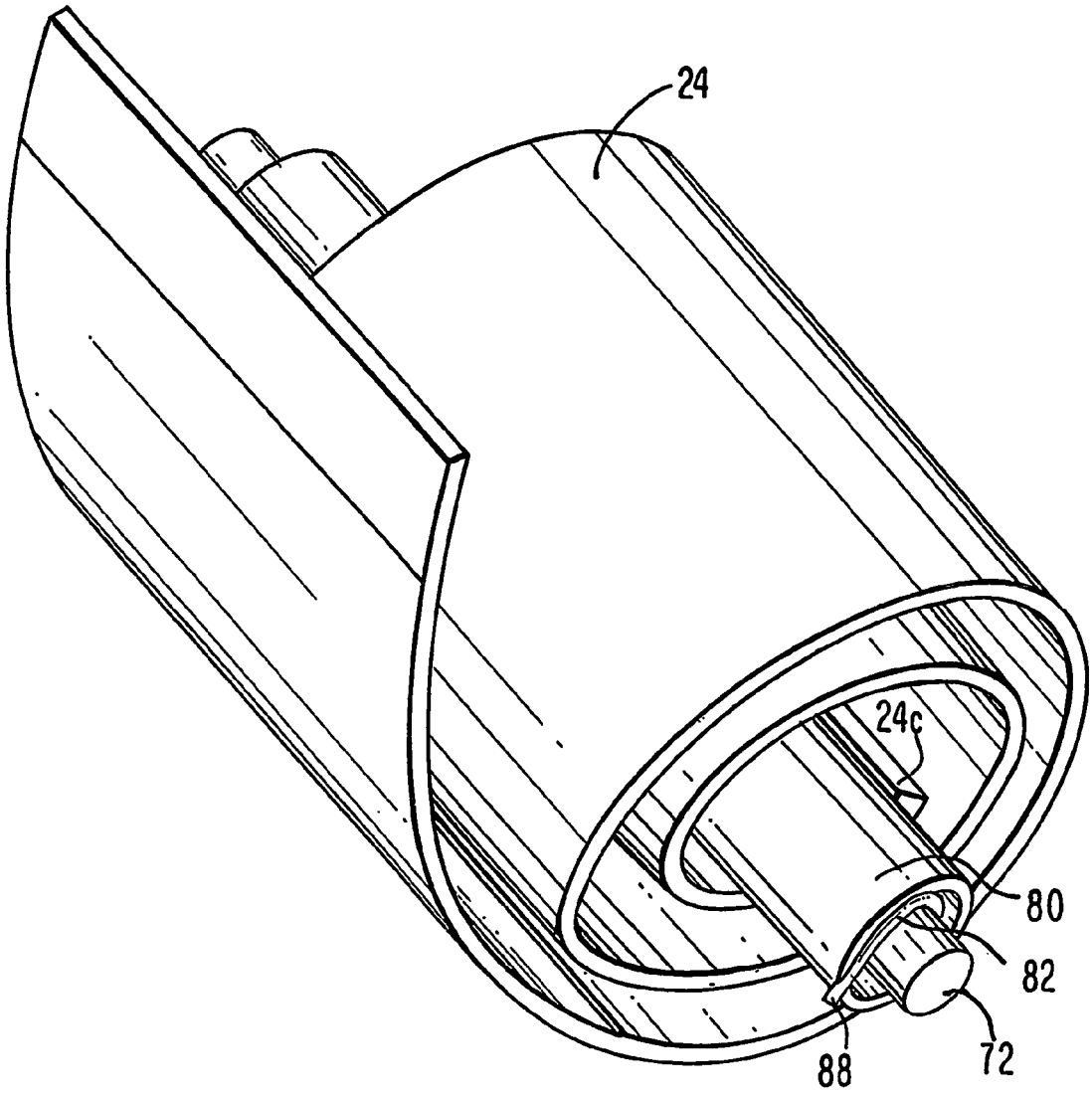
FIG. 21 is an enlarged perspective view of the rotatable axle and wire-type torsion spring shown in FIG. 20, illustrating the short arm of the spring which is fixed to the rotatable axle such that rotation of the spring with the axle causes the wire type torsion spring to store energy.
Figure 22:
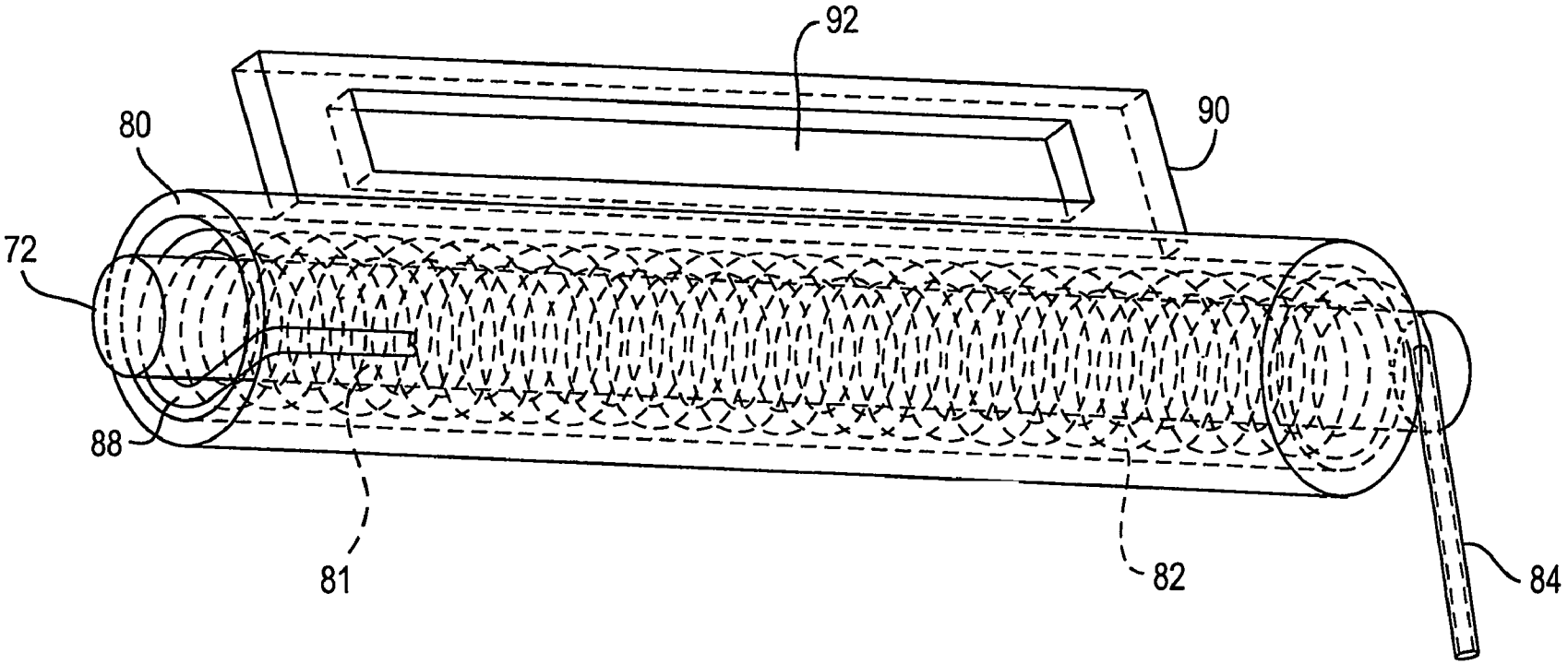
FIG. 22 is a front elevational view of the spring unit incorporated into the embodiments of FIGS. 14-21, illustrating the wire-type torsion spring having one short end attached to the rotatable axle and one long end opposite the short end attached to the housing of the spring compartment to permit the spring to store energy when the axle is rotated corresponding to extension movement of the shoulder strap.

FIG. 20 illustrates to a perspective view of the coil-type torsion spring compartment 86 described in conjunction with FIGS. 14-19. In particular the device includes housing having a fixed shaft 72 about which rotatable axle 80 is positioned. A piano wire coil-type torsion spring 82 includes a long arm extension 84 which is fixed to the housing 86 as shown at one end. A short arm extension 88 is fixed to the rotatable axle 80 as shown in FIG. 21. The rotatable axle 80 is arranged to be rotatable about fixed shaft 72. The shoulder strap webbing 24 is attached to the axle at end 24*c* as shown in FIG. 21 and is made to wrap up about itself in a coiled arrangement as shown. Thus when the strap 24 is pulled upwardly by a user, the coil spring 82 is permitted to store energy by deformation of the spring. In particular the deformation of the spring is a shortening of the spring length which reduces the pitch of the spring, the pitch being the distance between the coils. Releasing the strap allows the spring to return to its normal pitch and releases the energy stored when the strap 24 was pulled upwardly and the spring was made to shorten. Such release causes a counter-rotation of the axle and retraction of the webbing into the spring compartment 86. In particular the spring 82 is more clearly shown in FIG. 22. Short extension 88 which is attached to axle 80 is shown in FIG. 22 and long extension 84 which is attached to the housing 86 is also shown. It should be noted that the short extension which is attached to the axle 80 must be attached to axle 80 through a slot 81 in the axle in order to accommodate the change of length of the coil spring 82 as the coil spring stores energy and shortens and releases energy by lengthening. Slotted rectangular shaped belt attachment buckle 90 is attached to the rotatable axle 80 for suitably attaching the shoulder strap web 24 thereto to the axle by looping the web through the elongated rectangular slot 92 as shown in FIG. 22.

Figure 23:
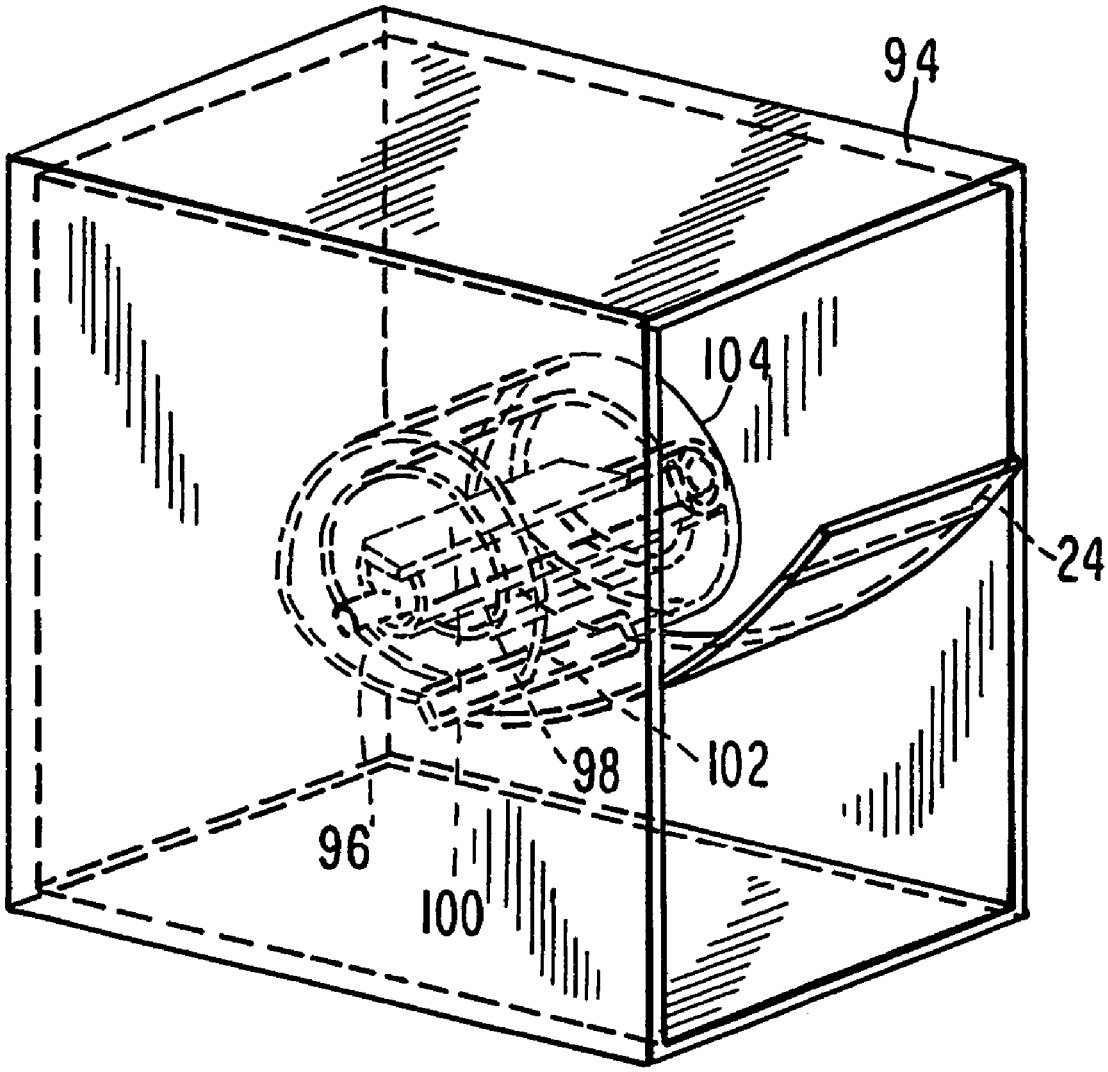
FIG. 23 is a left side and front perspective view from above, of an alternative embodiment of the shoulder strap spring compartment of the present invention, incorporating a flat strap-type torsion spring for storing energy to provide resilient return force to the shoulder strap of a carrying case when the shoulder strap is moved to an extended position, one end of the strap type torsion spring being attached to the rotatable axle about which the shoulder strap is wrapped, and the other end of the torsion spring being attached to one end of the shoulder strap such that extension of the shoulder strap causes the strap-type spring to unwind and store energy so as to provide energy to retract the shoulder strap when it is rewound.

Referring now to FIG. 23 there is shown still another alternative embodiment of the invention wherein a spring compartment 94 includes a steel strap-type spring 96 which is coiled upon itself and which is made of spring steel. The coiled strap spring is attached to the rotatable axle 98 by attachment at one end 100 as shown, and at the other end the strap spring is attached to the webbing 24 at attachment 102 as shown. Rotatable axle 104 is shown as being attached at 100 to the coil-type torsion strap spring. In operation, when the nylon shoulder strap 24 is extended upwardly the coil-type strap spring is made to unwind and to store energy and when the strap is released the energy stored in the coil strap spring will cause the axle 104 to rotate and the web 24, to return to the wound position about the strap spring as shown schematically in FIG. 23.

In the embodiment of FIG. 23, as in all embodiments described previously, a suitable locking mechanism of the type generally known and used in the automobile industry in safety straps and shoulder harnesses can be used to lock the shoulder strap in a preselected position. Alternatively the slider block mechanism shown in FIGS. 12, 13, 18 and 19 may also be used. Alternatively any locking mechanism may be used in conjunction with the present invention. As noted, the coil type wire springs are generally made of spring steel piano wire; however, alternative spring materials may be used. Further as noted, various combinations of the features shown and described herein may be used in different combinations with each other as well as with alternative materials known to persons skilled in the art.

It should also be noted that the extension-type coil springs are preferably of the type that will have a one hundred thousand or more cycle life and capable of undergoing approximately eighty percent (80%) of maximum elongation for commercial use. As noted previously the spring rate of the springs which are used will be determined individually by the need in each series of carrying eases in order to provide the appropriate force to the webbing material.

The invention is usable with carrying cases of all types, including leather, vinyl or cloth luggage, briefcases, or the like.

By concentrating as many springs as may be required in a compartment of relatively small dimensions, a predetermined substantial retraction force can be provided without encumbering the carrying case with additional substantial bulk.

The invention claimed is:

1. A retractable strap device for a carry case, which comprises:

a) a flexible strap having at least first and second end portions; and b) at least a first strap retractor device, which comprises a first housing adapted to be mounted on a first part of the carry case, said first housing including at least two coil-type extension springs, each said spring having a first end coupled to said first housing and a second end coupled to said first end portion of said strap, said first strap retractor device being arranged to bias said first end portion of said strap toward a retracted position with respect to the carry case, and having means associated therewith for selective take-up and storage of at least a portion of said strap in said first housing, and at least a second strap retractor device adapted to be mounted on at least a second part of the carry case, said second strap retractor device comprising a second housing adapted to be mounted to at least a second part of the carry case generally opposite the first part of the carry case, said second housing including at least two coil-type extension springs, each said spring having a first end coupled to said second housing and a second end coupled to said second end portion of said strap, said second strap retractor device arranged to bias said second end portion of said strap generally opposite to said first end portion of said strap and having means associated therewith for take-up and storage of at least a portion of said strap in said second housing.

2. The retractable strap device according to claim 1, wherein each said first and second strap retractor device includes at least three coil-type extension springs.

3. The retractable strap device according to claim 1, wherein each said spring is retained within said respective housing, each said second end of each said spring coupled to a slider device, said respective slider devices adapted to selectively take-up and extend said strap in response to forces applied to said strap.

4. The retractable strap device according to claim 3, wherein each respective end of said strap is coupled to said respective slider device, each said respective slider device defining an aperture for passage therethrough of said strap, such that when said strap is extended in a direction away from the carry case, said springs are extended, and when said strap is relaxed, said springs retract and cause said strap to retract and be stored within said housing.

5. The retractable strap device according to claim 4, wherein each said housing includes a fixed elongated member attached to said housing and oriented transversely to said strap, and each said first and second end portions of said strap is respectively associated with a respective fixed elongated member.

6. The retractable strap device according to claim 5, wherein each said first and second end portions of said strap is respectively wrapped around said associated fixed elongated member within said associated housing and looped through said aperture in said respective slider device for storage of at least a portion of said strap within each said respective housing.

7. The retractable strap device according to claim 6, wherein each said slider device associated with each said housing defines at least two apertures for reception of each respective end portion of said strap in a double looped manner to thereby increase the amount of strap storage capacity within said housing.

8. The retractable strap device according to claim 7, wherein each said housing includes resilient means positioned to be engaged by said slider device to absorb and store energy when said strap is extended to a position which causes said respective slider device to reach a predetermined location.

9. The retractable strap device according to claim 8, wherein each said housing forms at least a part of a frame structure for the carry case and is concealed within a part of the carry case.

10. The retractable strap device according to claim 9, further comprising a locking device adapted to prevent said strap from sliding movement relative to said strap retractor device.

11. The retractable strap device according to claim 10, wherein said locking device comprises a first slotted block and a second slotted block, said strap passing through both said slotted blocks, at least one of said blocks being movable laterally with respect to the other to lock the position of said carry strap at a selected location on said strap to prevent further movement of said strap into said respective retractor device.

12. A retractable strap device for a carry case, which comprises:

a) a flexible carry strap having at least first and second end portions;

b) a housing adapted to be mounted on at least one side of the carry case, said housing being subdivided into at least two sections, a first section associated with one end portion of said carry strap, and a second section adjacent said first section and associated with a second end portion of said carry strap;

c) at least a first pair of coil-type extension springs positioned in said first section and at least a second pair of coil-type extension springs positioned in said second section, each said pair of springs respectively having one end coupled to said housing and a second end coupled to a slider device, each said slider device defining an opening for reception of a portion of said carry strap; and d) an elongated member respectively fixedly attached to each said first and second sections of said housing and oriented transverse to said carry strap, each said elongated member being spaced from said respective slider device and being positioned to receive a portion of said strap wrapped therearound such that application of force to said respective end portions of said carry strap causes said carry strap to extend its exposed length outside the carry case as said respective extension springs become extended in respectively opposite directions, and releasing the force on said carry strap permits said respective extension springs to retract in respectively opposite directions and apply opposed resilient forces to said respective end portions of said carry strap to cause said opposed portions of said carry strap to return to their stored positions within said housing.

13. The retractable strap device according to claim 12, wherein each said first and second sections of said housing includes at least three coil-type extension springs.

14. A retractable strap device for a carry case, which comprises:

a) a flexible carry strap having at least first and second end portions;

b) a first strap retractor device which includes a first housing adapted to be mounted on a first side of the carry case, said first strap retractor device including at least two coil-type extension springs; and c)a second strap retractor device which includes a second housing adapted to be mounted on at least a second part of the carry case, said second strap retractor device including at least two coil-type extension springs; and d) means associated with each said first and second housing for take-up and storage of at least a portion of said strap within said respective housing, each said extension spring being mounted within each said respective housing, and having a first end coupled to said respective housing, and a second end respectively coupled to respective opposed end portions of said carry strap, said springs adapted and arranged to cause said respective opposed end portions of said carry strap to be retracted within said housing when each said spring retracts, and to permit each respective end portion of said carry strap to be extended in respective opposite directions when extension force is applied to said carry strap, thereby causing at least portions of said respective end portions of said carry strap to exit each said housing.

15. A retractable strap device for a carry case, which comprises:

a) a flexible strap having a central portion and at least first and second end portions;

b) at least one first strap retractor device adapted to be mounted on at least one first side of the carry case, said first strap retractor device comprising a first housing which includes at least two resilient coil-type extension springs, each said spring being coupled at one first end thereof to said first housing, and at another second end thereof to one respective end portion of said flexible strap; and c) at least one second strap retractor device adapted to be mounted to at least one second side of the carry case generally opposite said first side, said second strap retractor device comprising a second housing which includes at least two resilient coil-type extension springs, each said spring being coupled at one first end thereof to said second housing, and at a second end thereof to said second end portion of said flexible strap;

d) means associated with each said first and second housing for take-up and storage of respective end portions of said flexile strap, whereby said first and second end portions of said flexible strap are retracted into each said respective housing by inward forces provided by said resilient springs, and when outward force is applied to said flexible strap to cause said first and second end portions to move away from said respective first and second housings, said springs become extended so as to permit outward movement of said strap away from said respective housings, while providing resilient return forces to said strap, such that when said outward force is removed, each said respective end portion of said flexible strap is taken up and returned to respective stored positions within each said respective housing and said central portion of said strap between said opposed end portions assumes a position closer to the carry case.

16. The retractable strap device according to claim 15, wherein each said housing is an elongated member having at least three sides, a first side having means to attach one end of each said springs thereto, and second and third sides.

17. The retractable strap device according to claim 16, wherein said first side of each said housing is shorter than said second and third sides.

18. The retractable strap device according to claim 17, wherein said strap retractor device includes a slider device coupled to the second end of each said spring, and one end of said flexible strap is attached to said slider device.

19. The retractable strap device according to claim 18, wherein an elongated pin is attached to each said housing and oriented in a direction generally transverse to the direction of movement of said flexible strap, said strap being looped around said pin and extending through an aperture in said slider device, and exiting said housing such that outward forces applied to said strap cause said strap to be withdrawn from said housing against the forces provided by said springs, and relaxation of said outward forces causes said springs to return to their unloaded condition, and said end portions of said strap to return to a stored and wrapped position within each said housing.

20. The retractable strap device according to claim 19, wherein each said slider device defines two apertures to receive said flexible strap in a double-wrapped arrangement.

21. The retractable strap device according to claim 20, wherein each said housing is made of a plastic material.

22. The retractable strap device according to claim 21, wherein said plastic material is polypropylene or acrylonitrile-butadiene styrene.

23. The retractable strap device according to claim 22, wherein each said slider device comprises a pair of engagement pads at each end thereof, and each said housing includes a pair of impact springs positioned and adapted to be engaged by said pads when each said respective slider device is moved to a predetermined position, whereby said impact springs absorb and store energy from each said slider device when said flexible strap is extended away from the carry case to a predetermined position.

24. The retractable strap device according to claim 23, wherein said flexible strap extends through a strap locking device, said locking device comprising a first fixed block and a second slider block movable between a first position which permits passage of said strap through respective apertures in said blocks, and a second position of misalignment of said apertures which prevents passage of said strap through said block.

25. The retractable strap device according to claim 24, wherein said slider block comprises a manually operable pin attached thereto and said block is manually actuable by said manually operable pin.

26. An article carrying apparatus having a retractable strap, which comprises:

a) a carry case;

b) a flexible strap having at least first and second end portions; and c) at least one first strap retractor device mounted on at least a first part of said carry case, said first strap retractor device including at least two coil-type extensions springs respectively coupled to a first end portion of said strap to bias said first end portion of said strap toward a retracted position with respect to said carry case, and a second end portion of said strap opposed to said first end portion and being attached to a correspondingly opposed second strap retractor device mounted on a second part of said carry case generally opposite said first part, said second strap retractor device including at least two coil-type extension springs, said first and second strap retractor devices each having means for take-up and storage of at least respective end portions of said flexible strap when said springs are in retracted positions, whereby application of force to said strap in a direction away from said carry case causes said extension springs to become extended, while applying retraction forces to said respective end portions of said strap, and releasing said force from said strap permits said springs to retract and to thereby cause at least end portions of said strap to be retracted and stored in said respective strap retractor devices.

27. The carry case according to claim 26, wherein said first and second retractor strap devices are mounted to a frame structure of the carry case and concealed within respective parts of the carry case.

28. A method of providing a retractable carry strap for a carry case, which comprises:

a) providing a flexible strap having a generally central section and first and second end portions;

b) mounting a first strap retractor device on at least a first part of the carry case, said first strap retractor device comprising a first housing which includes at least two coil-type extension springs, each said spring having a first end coupled to said first housing and a second end coupled to said first end portion of said flexible strap, said first strap retractor device being arranged to bias said first end portion of said strap toward said first strap retractor device and having means associated therewith for take-up and storage of at least a portion of said strap in said first housing;

c) mounting a second strap retractor device on at least a second part of the carry case opposite said first part, said second strap retractor device comprising a second housing which includes at least two coil-type-extension springs, each said spring having a first end coupled to said second housing and a second end coupled to said second end portion of said flexible strap, said second strap retractor device being arranged to bias said second end portion of said strap toward said second strap retractor device and having means associated therewith for take-up and storage of at least a portion of said strap in said second housing; and d) concealing said first and second strap retractor devices within said first and second parts of the carry case.

29. The method according to claim 28, wherein the carry case has a frame structure and said first and second retractor devices are mounted to said frame structure.

30. The method according to claim 29, wherein the carry case is an item of luggage.

31. The method according to claim 30, wherein each said extension spring has a first end coupled to said respective housing and a second end coupled to a respective slider device, each said slider device adapted to selectively take-up and extend said strap in response to forces applied to said strap.

32. The method according to claim 31, wherein each said slider device defines an aperture for passage of said strap therethrough, such that when said strap is extended in a direction away from the carry case, said springs are extended, and when said strap is relaxed, said springs retract and cause said strap to retract and be stored within said housing.

33. The method according to claim 32, wherein each said retractor housing includes a fixed elongated member oriented transversely to said strap.

34. The method according to claim 33, wherein each end portion of said strap is respectively wrapped around said associated fixed elongated member within said associated housing and looped through said aperture in said respective slider device for storage of at least a portion of said strap within each said respective housing.

35. The method according to claim 34, wherein each said slider device associated with each said housing defines two apertures for reception of each respective end portion of said strap in a double looped manner to thereby increase the amount of strap storage capacity within said housings.

36. The method according to claim 35, wherein each said housing includes resilient means positioned to be engaged by said slider device to absorb and store energy when said strap is extended to a position which causes said slider device to reach a predetermined location.

37. The method according to claim 36, wherein each said housing forms at least a part of said frame structure of the carry case and is concealed within a part of the carry case.

38. The method according to claim 37, further comprising a locking device adapted to prevent said strap from sliding movement relative to said retractor device.

39. The method according to claim 38, wherein said locking device comprises a first slotted block and a second slotted block, said strap passing through both said slotted blocks, at least one of said blocks being movable laterally with respect to the other to lock the position of said strap at a selected location on said strap to prevent further movement of said strap into said respective retractor device.

40. An article carrying apparatus having a retractable strap, which comprises:

a) a carry case;

b) a flexible strap having at least first and second end portions; and c) at least a first strap retractor device mounted on at least a first part of said carry case, said first strap retractor device including a first housing having at least two coil-type extension springs, each said spring having a first end coupled to said first housing and a second end coupled to said first end portion of said strap, said first strap retractor device being arranged to bias said first end portion of said strap toward a retracted position with respect to said carry case, said first strap retractor device having means associated therewith for take-up and storage of at least a portion of said strap in said first housing, and at least a second strap retractor device mounted on a second part of said carry case opposite said first part, and including a second housing having at least two coil-type extension springs, each said spring having a first end coupled to said second housing and a second end coupled to said second end portion of said strap, said second strap retractor device being arranged to bias said second end portion of said strap generally opposite to said first end portion of said strap and having means associated therewith for take-up and storage of at least a portion of said strap in said second housing, whereby application of force to said strap in a direction away from said carry case causes said extension springs to become extended while applying retraction forces to said respective end portions of said strap, and releasing said force from said strap permits said springs to retract and to thereby cause at least respective end portions of said strap to be retracted and stored in said respective strap retractor devices.

* * * * *